US009518793B1

(12) United States Patent
Stakes

(10) Patent No.: US 9,518,793 B1
(45) **Date of Patent: *Dec. 13, 2016**

(54) TRIGGER MECHANISM

(71) Applicant: TAC-CON DISTRIBUTION, LLC, Tucson, AZ (US)

(72) Inventor: Michael A. Stakes, Phoenix, AZ (US)

(73) Assignee: Tac-Con Distribution, LLC, New River, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/867,334

(22) Filed: Sep. 28, 2015

Related U.S. Application Data

(63) Continuation of application No. 13/919,085, filed on Jun. 17, 2013, now Pat. No. 9,146,067.

(51) Int. Cl.
*F41A 19/00* (2006.01)
*F41A 19/10* (2006.01)
*F41A 19/14* (2006.01)

(52) U.S. Cl.
CPC ..... *F41A 19/10* (2013.01); *F41A 19/14* (2013.01)

(58) Field of Classification Search
USPC ..... 42/69.01, 69.03, 20; 89/144, 139, 147, 89/27.11
See application file for complete search history.

(56) References Cited

U.S. PATENT DOCUMENTS 4,004,496 A 1/1977 Snodgrass et al.
5,501,134 A 3/1996 Milazzo et al.
5,680,724 A 10/1997 Peterken
5,881,485 A 3/1999 Milazzo
6,131,324 A 10/2000 Jewell
6,615,527 B1 9/2003 Martin
7,331,136 B2 2/2008 Geissele
7,398,723 B1 7/2008 Blakley
7,421,937 B1 9/2008 Gangl
7,600,338 B2 10/2009 Geissele
7,854,084 B1 12/2010 Rutherford
8,047,119 B2 11/2011 Hochstrate et al.
8,069,602 B2 12/2011 Geissele
8,074,393 B2 12/2011 Geissele
8,667,881 B1 3/2014 Hawbaker
2003/0126781 A1 7/2003 Herring
2003/0136041 A1 7/2003 Herring
2006/0086031 A1 4/2006 Geissele
2007/0051236 A1 3/2007 Groves et al.
2009/0183414 A1 7/2009 Geissele
2009/0188145 A1 7/2009 Fluhr et al.
2010/0281739 A1 11/2010 Geissele
2011/0099871 A1 5/2011 Geissele
2011/0167697 A1 7/2011 Geissele
2011/0185615 A1 8/2011 Gangl
2012/0180356 A1 7/2012 Bender

*Primary Examiner* — J. Woodrow Eldred
(74) *Attorney, Agent, or Firm* — Michael W. Goltry; Robert A. Parsons; Parsons & Goltry

(57) ABSTRACT

A trigger mechanism includes a hammer, and a trigger disconnector assembly including a trigger body having a trigger nose, and a disconnector having a disconnector hook. A reset lever is mounted for movement between open and closed positions. The trigger disconnector assembly is in mechanical communication with the reset lever. A striking end of the hammer strikes the reset lever in a past-cocked position of the hammer moving the reset lever from the open position to the closed position, the reset lever acting on the trigger disconnector assembly to reset the trigger body and the disconnector in the past-cocked position of the hammer in preparation for securing the hammer in a cocked position preparatory to firing by another trigger pull of the trigger body.

3 Claims, 20 Drawing Sheets

TRIGGER MECHANISM

FIELD OF THE INVENTION

The present invention relates to trigger mechanisms.

BACKGROUND OF THE INVENTION

There are numerous trigger mechanisms capable of being locked in safe, semi-automatic, burst, and fully automatic operation. Different variations of rifles will allow some or all of the various modes of operation. Selector mechanisms have been developed for use with the trigger mechanisms to select between some or all of the various modes.

In firearms limited to safe and semi-automatic modes of operation, one of the drawbacks to the trigger mechanism occurs when the hammer is returned to the cocked position by the bolt carrier. After firing a round, the bolt carrier moves rearwardly, contacting the hammer and pivoting the hammer backwards into the cocked position. This action results in the sear hook at the striking end of the hammer directly striking the hammer-receiving surface of the disconnector and transferring energy to an operator's finger upon the trigger in the form of a sharp snap or forward movement of the trigger. After repeated firings of the weapon, this trigger snap can begin to cause bruising or other injury to the finger, making continued firing uncomfortable. Another drawback to the trigger mechanism occurs after firing when the trigger nose resets into the trigger notch of the hammer to prevent forward motion of the hammer preparatory to firing by another trigger pull, where there is a substantial pause as the hammer travels rearwardly from the cocked position, to the past-cocked position, and then forwardly to the cocked position preparatory to firing by another trigger pull. This pause inherently limits the speed of repeated trigger pulls in the semi-automatic mode of operation, which, for many competitive shooters, is not satisfactory. Accordingly, there is a need in the art for a trigger mechanism that limits trigger snap and improves the trigger-to-hammer reset between trigger pulls in the semi-automatic mode of operation.

SUMMARY OF THE INVENTION

According to the principle of the invention, a trigger mechanism includes a trigger disconnector assembly having a trigger nose, and a disconnector having a disconnector hook. A reset lever is mounted for pivotal movement between open and closed positions. The trigger disconnector assembly is mounted for pivotal movement between charged and discharged orientations, the charged orientation being a set position of the trigger nose and a disengaged position of the disconnector hook, and the discharged orientation being a released position of the trigger nose and an engaged position of the disconnector hook. A hammer includes a striking end, a hammer disconnect notch, a pivot end pivotable about a hammer pivot between a firing position of the striking end, a cocked position of the striking end, and a past-cocked position of the striking end, and a trigger notch formed in the pivot end for receiving the trigger nose in the cocked position of the hammer. The trigger disconnector assembly is in mechanical communication with the reset lever, the striking end of the hammer strikes the reset lever in the past-cocked position of the hammer pivoting the reset lever from the open position to the closed position, the reset lever acting on the trigger disconnector assembly to pivot the trigger disconnector assembly from the discharged orientation to the charged orientation when the reset lever moves from the open position to the closed position, to position the trigger nose in the set position in preparation to be received by the trigger notch in the cocked position of the hammer and to position the disconnector in the disengaged position of the disconnector hook relative to the hammer disconnect notch. A spring keeps tension on the reset lever urging the reset lever toward the closed position. The reset lever isolates the hammer from the trigger disconnector assembly, preventing the hammer from striking the trigger disconnector assembly in the past cocked position of the hammer.

According to the principle of the invention, a trigger mechanism includes a trigger disconnector assembly having a trigger nose, and a disconnector having a disconnector hook and a cam surface. A reset lever is mounted for pivotal movement between open and closed positions. The trigger disconnector assembly is mounted for pivotal movement between charged and discharged orientations, the charged orientation being a set position of the trigger nose and a disengaged position of the disconnector hook, and the discharged orientation being a released position of the trigger nose and an engaged position of the disconnector hook. A hammer includes a striking end including a striking surface and an opposed hammer tail, a hammer disconnect notch, a pivot end pivotable about a hammer pivot between a forward position of the striking end, a cocked position of the striking end, and a past-cocked position of the striking end, and a trigger notch formed in the pivot end for receiving the trigger nose in the set position of the trigger nose and the cocked position of the hammer. The cam surface of the trigger disconnector assembly is in mechanical communication with the reset lever, the hammer tail of the striking end of the hammer strikes the reset lever in the past-cocked position the hammer pivoting the reset lever from the open position to the closed position, the reset lever acting on the cam surface to pivot the trigger disconnector assembly from the discharged orientation to the charged orientation when the reset lever moves from the open position to the closed position, to position the trigger nose in the set position in preparation to be received by the trigger notch in the cocked position of the hammer and to position the disconnector in the disengaged position of the disconnector hook relative to the hammer disconnect notch. A spring keeps tension on the reset lever urging the reset lever toward the closed position. The reset lever isolates the hammer from the trigger disconnector assembly, preventing the hammer from striking the trigger disconnector assembly in the past cocked position of the hammer. The hammer tail of the hammer strikes the reset lever in the past-cocked position of the hammer at a location between the cam surface and the disconnector hook.

According to the principle of the invention, a trigger mechanism includes a trigger body having a trigger nose and a trigger pivot for pivotally coupling the trigger body to a firearm for movement of the trigger nose between set and released positions. A reset lever is mounted for pivotal movement between open and closed positions. A disconnector has a disconnector hook, and a disconnector pivot pivotally coupling the disconnector to the trigger pivot for movement of the disconnector hook between disengaged and engaged positions in response to pivotal movement of the trigger body between the set and released positions of the trigger nose, respectively. A hammer includes a striking end, a hammer disconnect notch, a pivot end pivotable about a hammer pivot between a firing position of the striking end, a cocked position of the striking end, and a past-cocked position of the striking end, and a trigger notch formed in the pivot end for receiving the trigger nose in the cocked position of the hammer. The disconnector is in mechanical communication with the reset lever, the striking end of the hammer strikes the reset lever in the past-cocked position of the hammer pivoting the reset lever from the open position to the closed position, the reset lever acting on the disconnector to concurrently pivot the disconnector from the engaged position of the disconnector hook to the disengaged position of the disconnector hook and the trigger body from the released position of the trigger nose to the set position of the trigger nose in preparation to be received by the trigger notch in the cocked position of the hammer when the reset lever moves from the open position to the closed position. A spring keeps tension on the reset lever urging the reset lever toward the closed position. The reset lever isolates the hammer from the trigger body and the disconnector, preventing the hammer from striking the trigger body and the disconnector in the past cocked position of the hammer.

According to the principle of the invention, a trigger mechanism includes a trigger body having a trigger nose and a trigger pivot for pivotally coupling the trigger body to a firearm for movement of the trigger nose between set and released positions. A reset lever is mounted for pivotal movement between open and closed positions. A disconnector has a disconnector lever, a disconnector hook, and a disconnector pivot pivotally coupling the disconnector to the trigger pivot for movement of the disconnector hook between disengaged and engaged positions in response to pivotal movement of the trigger body between the set and released positions of the trigger nose, respectively. A hammer includes a striking end, a hammer disconnect notch, a pivot end pivotable about a hammer pivot between a firing position of the striking end, a cocked position of the striking end, and a past-cocked position of the striking end, and a trigger notch formed in the pivot end for receiving the trigger nose in the cocked position of the hammer. The disconnector lever of the disconnector is in mechanical communication with the reset lever, the striking end of the hammer strikes the reset lever in the past-cocked position of the hammer pivoting the reset lever from the open position to the closed position, the reset lever acting on the disconnector lever to concurrently pivot the disconnector from the engaged position of the disconnector hook to the disengaged position of the disconnector hook and the trigger body from the released position of the trigger nose to the set position of the trigger nose in preparation to be received by the trigger notch in the cocked position of the hammer when the reset lever moves from the open position to the closed position. A spring keeps tension on the reset lever urging the reset lever toward the closed position. The reset lever isolates the hammer from the trigger body and the disconnector, preventing the hammer from striking the trigger body and the disconnector in the past cocked position of the hammer. The striking end of the hammer strikes the reset lever in the past-cocked position of the hammer at a location between the disconnector lever and the disconnector hook.

According to the principle of the invention, a trigger mechanism includes a trigger body having a trigger nose and a trigger pivot for pivotally coupling the trigger body to a firearm for movement of the trigger nose between set and released positions. A reset lever is mounted for pivotal movement between open and closed positions. A disconnector has a disconnector hook, a cam surface, and a disconnector pivot pivotally coupling the disconnector to the trigger pivot for movement of the disconnector hook between disengaged and engaged positions in response to pivotal movement of the trigger body between the set and released positions of the trigger nose, respectively. A hammer includes a striking end, a hammer disconnect notch, a pivot end pivotable about a hammer pivot between a firing position of the striking end, a cocked position of the striking end, and a past-cocked position of the striking end, and a trigger notch formed in the pivot end for receiving the trigger nose in the cocked position of the hammer. The cam surface of the disconnector is in mechanical communication with the reset lever, the striking end of the hammer strikes the reset lever in the past-cocked position of the hammer pivoting the reset lever from the open position to the closed position, the reset lever acting on the cam surface to concurrently pivot the disconnector from the engaged position of the disconnector hook to the disengaged position of the disconnector hook and the trigger body from the released position of the trigger nose to the set position of the trigger nose in preparation to be received by the trigger notch in the cocked position of the hammer when the reset lever moves from the open position to the closed position. A spring keeps tension on the reset lever urging the reset lever toward the closed position. The reset lever isolates the hammer from the trigger body and the disconnector, preventing the hammer from striking the trigger body and the disconnector in the past cocked position of the hammer. The striking end of the hammer strikes the reset lever in the past-cocked position of the hammer at a location between the cam surface and the disconnector hook.

According to the principle of the invention, a trigger assembly with a hammer having a trigger notch, a trigger body has a trigger nose, a trigger tail, and a trigger, the trigger nose for receiving the trigger notch in a cocked position of the hammer and a set position of the trigger body and for releasing the trigger nose when the trigger body is moved a travel distance from the set position to a fired position, a disconnector coupled between the hammer and the trigger body, and a selector movable between a first position and a second position for adjusting the travel distance of the trigger body. The selector has a first stop aligned with the tail of the trigger body in the first position, and a second stop aligned with the tail of the trigger body in the second position. The first stop is separated from tail of the trigger body a first distance in the set position of the trigger body in the first position of the selector, and the second stop is separated from tail of the trigger body a second distance in the set position of the trigger body in the second position of the selector. In the first position of the selector and the fired position of the trigger body the first distance between the first stop and the tail of the trigger body is closed and the tail contacts the first stop, and movement of the trigger body is arrested by the tail contacting the first stop. In the second position of the selector and the fired position of the trigger body the second distance between the second stop and the tail of the trigger body is closed and the tail contacts the second stop, and movement of the trigger body is arrested by the tail contacting the second stop. The second distance is less than the first distance, wherein the travel distance of the trigger body in the second position of the selector is less than the travel distance of the trigger body in the first position of the selector.

BRIEF DESCRIPTION OF THE DRAWINGS

Referring to the drawings.

DETAILED DESCRIPTION

Known trigger mechanisms used with various semi-automatic firearms that fire a single round each time the trigger is pulled and that have select fire capabilities that permit selection between safe and semi-automatic modes of operation include a trigger assembly having a trigger, a hammer having a sear hook, a disconnector, and a sear assembly. Operation of such a mechanism is well known to those skilled in the art and will not be described in detail, other than to describe how, after firing, the hammer is pivoted rearwardly by the action of the bolt carrier. As the hammer is moved to a cocked position and beyond to a past-cocked position, from the cocked position the hammer disconnect notch clips past the disconnector hook of the disconnector and over-travels to the past-cocked position where the portion of the hammer having the sear hook strikes the disconnector which in turn imparts the energy from the striking hammer to a rear portion of the trigger assembly, causing the trigger to sharply move or snap forward to reset the trigger nose relative to the trigger notch formed in the pivot end of the hammer where the hammer is retained in the cocked position by the trigger nose preparatory to firing by another trigger pull. The over-travel of the hammer from the cocked position to the past-cocked position delays the trigger-to-hammer reset, which limits the speed of semi-automatic fire.

To overcome this problem, a trigger mechanism, generally designated 20, is provided. It will be understood that trigger mechanism 20 is intended to be employed with any of the various semi-automatic firearms that fire a single round each time the trigger is pulled and that have select fire capabilities. It will also be understood that trigger mechanism 20 is carried by a lower receiver of a firearm. A lower receiver is not shown, as they are well known in the art and trigger mechanism 20 is carried in a conventional manner. Trigger mechanism 20 may also be formed as a drop-in trigger mechanism, as is the case with after-market trigger mechanisms.

Figure 3:
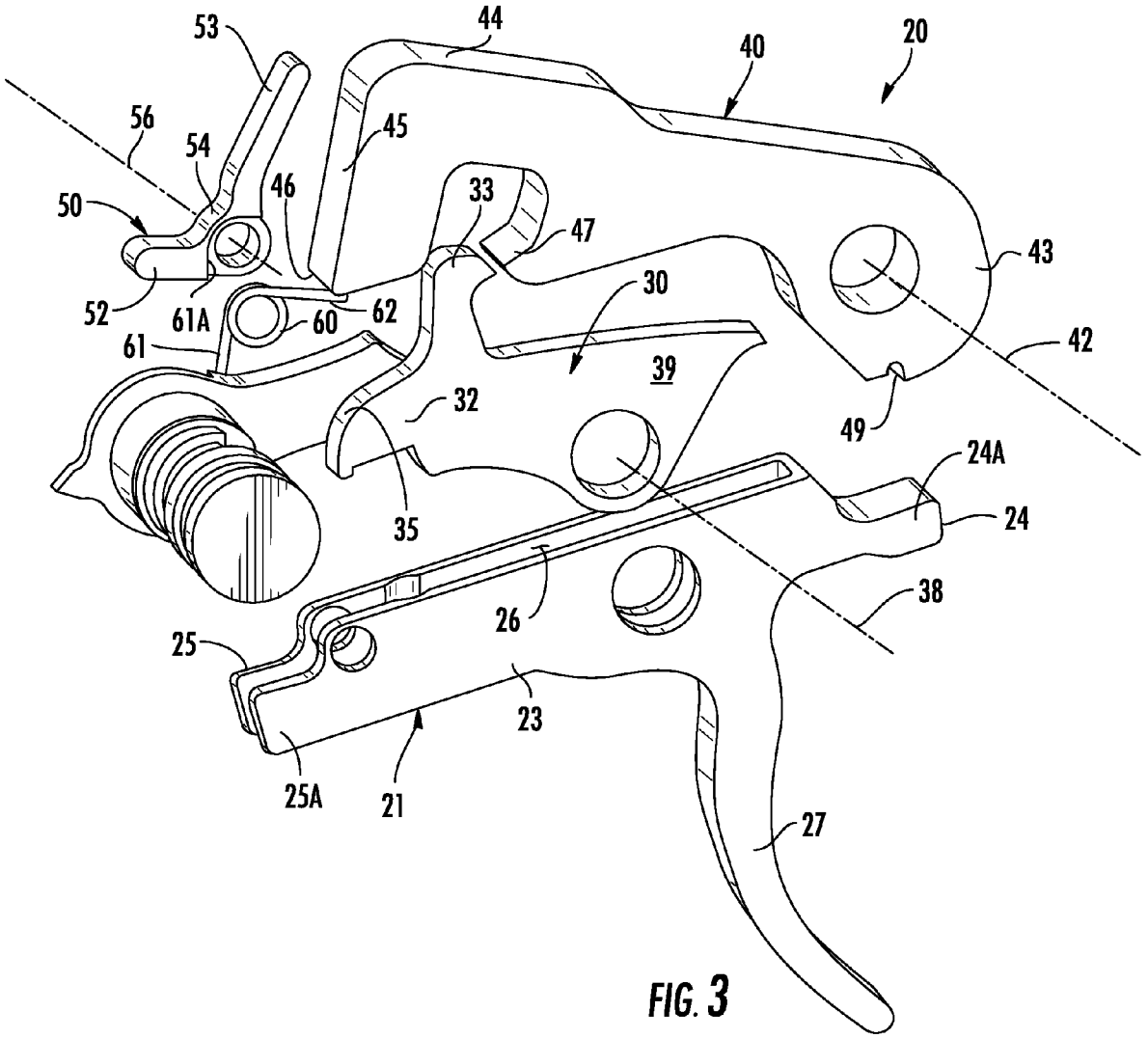
FIG. 3 is a partially exploded perspective view of the trigger body, the disconnector, the hammer, and the reset lever of the trigger mechanism of FIG. 1.

This particular trigger mechanism 20 allows selection between safe, semi-automatic, and assisted-reset semi-automatic modes of fire or operation. The assisted-reset semi-automatic mode of operation is a form of a semi-automatic mode of operation. Looking in relevant part to FIGS. 1-5, trigger mechanism 20 includes a trigger assembly 21 having a trigger body 23 with a trigger nose 24 at a head 24A of trigger body 23, a notch 25 at a tail 25A, and a trough 26 formed therein extending from tail 25A of trigger body 23 across a pivot 28 to just short of trigger nose 24 at head 24A. Trigger nose 24 is a part of head 24A of trigger body 23, and notch 25 is a part of tail 25A of trigger body 23. A trigger 27 extends from trigger body 23 generally at pivot 28. A disconnector 30 is positioned within trough 26 and is pivotally coupled to trigger assembly 21 at pivot 28. Disconnector 30 is a semi-automatic disconnector and is coupled between hammer 40 and trigger body 23. Disconnector 30 includes a rearwardly extending disconnector lever 32, and an upwardly extending disconnector hook 33. Disconnector lever 32 is positioned within trough 26 and includes a cam surface 35. Disconnector 30 pivots about a pivot or pivot point 38 denoted in FIG. 3, concurrent with pivot 28 of trigger assembly 22 as is known in the art. In this trigger mechanism 20, trigger body 23 and disconnector 30 concurrently pivot about pivot 28 and pivot point 38. Trigger assembly 21 has the customary and well-known trigger spring that acts on trigger body 23 so as to keep constant tension on trigger body 23 and thus trigger 27, the details of which are well-known to the skilled person. According to this disclosure, trigger body 23 and its various components and disconnector 30 and its various components cooperate to form a trigger disconnector assembly, which is denoted generally at 39.

Trigger mechanism 20 also includes a hammer 40 coupled for pivotal movement at a pivot 42 defined at a pivot end 43 of hammer 40 from a forward or firing position rearwardly to a cocked position and beyond to a past-cocked position as the rearward most position. Trigger assembly 21 has the customary and well-known hammer spring 48 that acts on hammer 40 so as to keep constant tension on hammer 40, the details of which are well-known to the skilled person.

Hammer 40 further includes a striking surface 44 formed in a striking end 45. Striking end 45 opposes pivot end 43, and has a hammer tail 46 opposite to striking surface 44. A trigger notch 49 is formed in pivot end 43. Trigger nose 24 is received in trigger notch 49, holding hammer 40 in the cocked position prior to firing. In this trigger mechanism 20, trigger notch 49 is formed perpendicular to the axis of rotation, directly in line with the center of pivot point 42.

Trigger mechanism 20 further includes an assisted-reset lever 50. Assisted-reset or reset lever 50 is positioned within trough 26 proximate to notch 25 of tail 25A and rearwardly of, or otherwise behind, disconnector lever 32 of disconnector 30 between selector 70 and disconnector lever 32 of disconnector 30 of disconnector assembly 39. Reset lever 50 includes two arms 52 and 53 connected at an angle at an intermediate portion, mid-section, or middle 54 of reset lever 50. Arms 52 and 53 are lever arms and are angularly offset relative to one another like a boomerang. In this reset lever 50, the angle between arms 52 and 53 is approximately 110 degrees, meaning 110 degrees+/−1-6 degrees variation as may be desired. Reset lever 50 is pivotally coupled to trigger body 23 of trigger assembly 21 at a pivot 56. Arm 52 is a rearwardly extending arm that extends rearwardly through trough 26 from pivot 56 at tail 25A of trigger body 23. Arm 53 is an upwardly extending arm that extends upwardly from pivot 56 and trough 26 at tail 25A of trigger body 23. Reset lever 50 pivots or pivotally moves at pivot 56 in the directions of double arrowed line A in FIGS. 1 and 2 between what is considered an inoperative position as shown in FIGS. 1, 2, 4, and 6-9, and what is considered an operative position as shown in FIGS. 3, 5, and 10-14 relative to the trigger disconnector assembly 39 and, more specifically, relative to cam surface 35 of disconnector 30 of trigger disconnector assembly 39.

In the inoperative position of reset lever 50, arm 53 is in an inoperative position, which is an aft or rearward upright position toward selector 70 and away from trigger disconnector assembly 39. In a further and more specific aspect, in the inoperative position of reset lever 50, arm 53 is in an inoperative position, which is an aft or rearward upright position toward selector 70 and away from cam surface 35 of disconnector 30 of trigger disconnector assembly 39. In the inoperative position of reset lever 50, arm 53 is de-united from or otherwise not in contact with cam surface 35 and is held there by selector 70. In the operative position of reset lever 50, arm 53 is in an operative position, which is a fore or forward upright position away from selector 70 and toward and in contact against disconnector assembly 39. In a further and more specific aspect, in the operative position of reset lever 50, arm 53 is in an operative position, which is a fore or forward upright position away from selector 70 and toward and in contact against cam surface 35 of disconnector 30 of trigger disconnector assembly 39.

A reset lever spring 60 is coupled between reset lever 50 and trigger body 23 of trigger assembly 21. Reset lever spring 60 keeps constant tension on reset lever 50. Here, reset lever spring 60 is a compression spring having active coils with a constant moduli of elasticity encircled about pivot 56, a tag end 61 connected to arm 52, and a tag end 62 connected to trigger body 23 of trigger assembly 21. Tag end 61 is received in and against a notch 61A formed in reset lever 50 between middle 54 and arm 52 and there tag end 61 is held. Tag end 62 extends downwardly through trough 26 from pivot 56 and through a small opening 62A in a bottom wall of trigger body 23 and there tag end 62 is held. Reset lever spring 60 constantly acts on reset lever 50 keeping constant tension on reset lever 50 constantly biasing/urging/tensioning reset lever 50 from its inoperative position relative to trigger disconnector assembly 39 to its operative position relative to trigger disconnector assembly 39.

Trigger mechanism 20 is a select fire trigger mechanism that has safe, semi-automatic, and assisted-reset semi-automatic modes of fire or operation, which are set or activated by a selector 70. Selector 70 is mounted for rotation so to rotate and is situated in notch 25 of trigger body 23 and has a handle 71 used to rotate selector 70 between different positions including a position corresponding to a safe mode of operation as in FIG. 1, another position corresponding to a semi-automatic mode of fire or operation as in FIG. 4, and yet another position corresponding to an assisted-reset semi-automatic mode of fire or operation as in FIG. 5, wherein these positions of selector 70 are different from one another. Trigger mechanism 20 is rendered inoperative in the safe mode of selector 70, trigger mechanism 20 is rendered operative for semi-automatic fire in the semi-automatic mode of selector 70, and trigger mechanism 20 is rendered operative for assisted-reset semi-automatic fire in the assisted-reset semi-automatic mode of selector 70.

Figure 1:
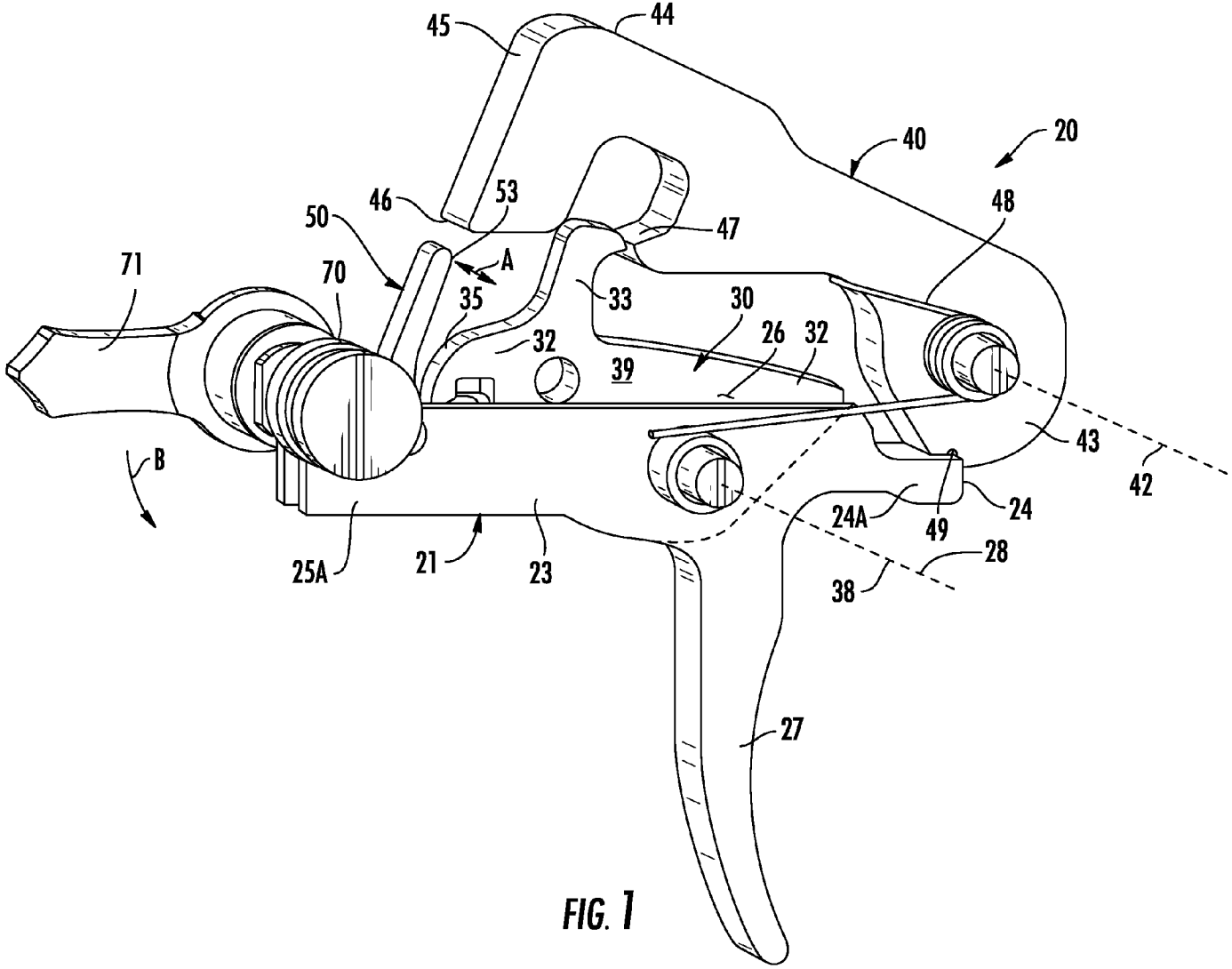
FIG. 1 is a perspective view of a trigger mechanism constructed and arranged in accordance with the principle of the invention, the trigger mechanism including a trigger body, a disconnector, a hammer, a reset lever, and a selector, and the trigger mechanism being shown as it would appear in a safe mode of operation.
Figure 2:
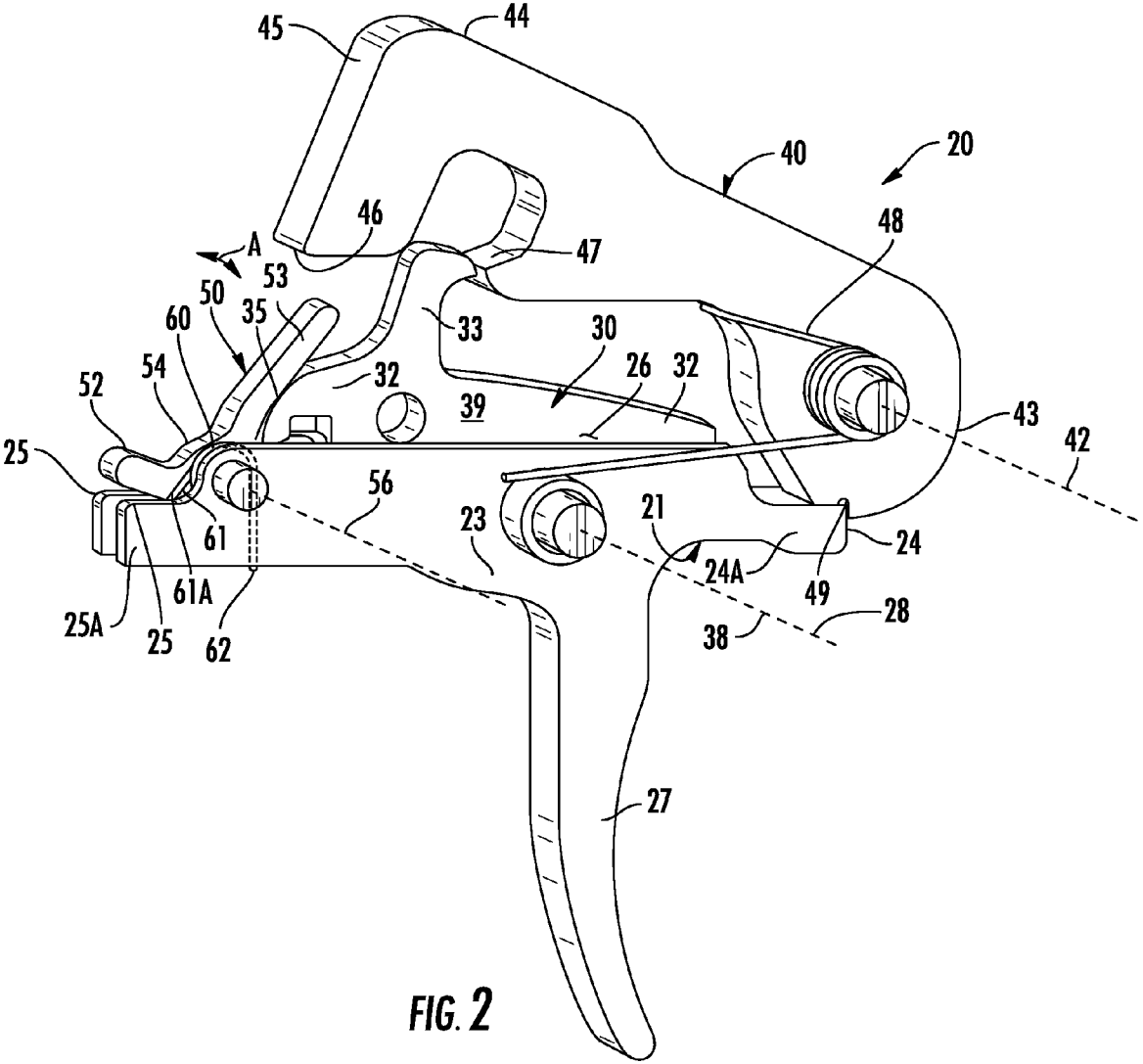
FIG. 2 is a view similar to that of FIG. 1 with portions thereof being shown in phantom outline for illustrative purposes.
Figure 2A:
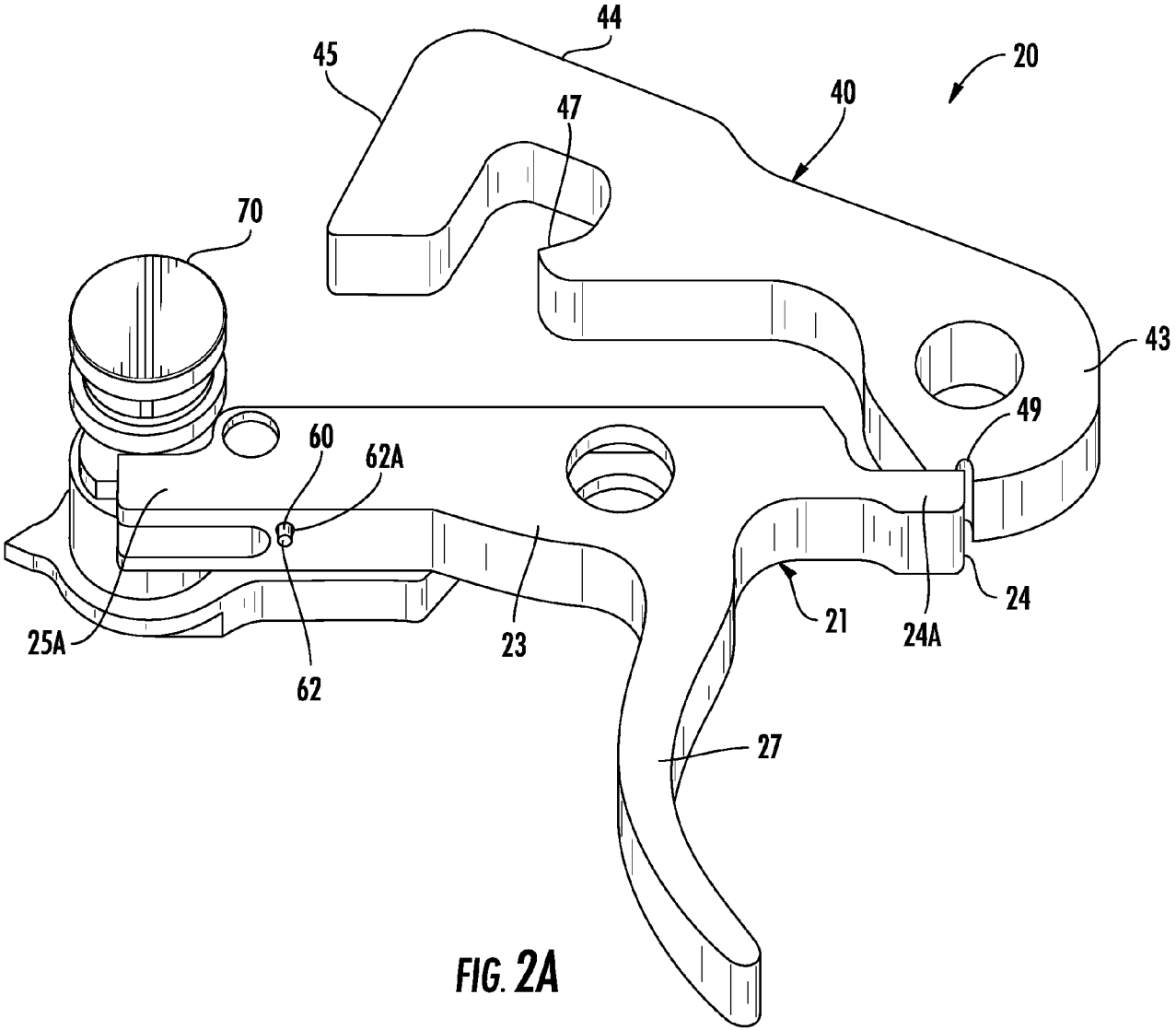
FIG. 2A is a bottom perspective view of the trigger body, the disconnector, and the hammer of the embodiment of FIG. 1.

FIG. 1 shows trigger body 23 and disconnector 30 that form trigger disconnector assembly 39, hammer 40, reset lever 50, and selector 70 of trigger mechanism 20 in the safe mode of operation. In FIG. 1, selector 70 is in the safe mode or safe setting and trigger nose 24 is received in trigger notch 49, holding hammer 40 in the cocked position. In the safe mode position of selector 70, trigger mechanism 20 is disabled and incapable of being fired. At the same time, selector 70 engages arm 52 of reset lever 50 holding reset lever 50 in its inoperative position.

Figure 4:
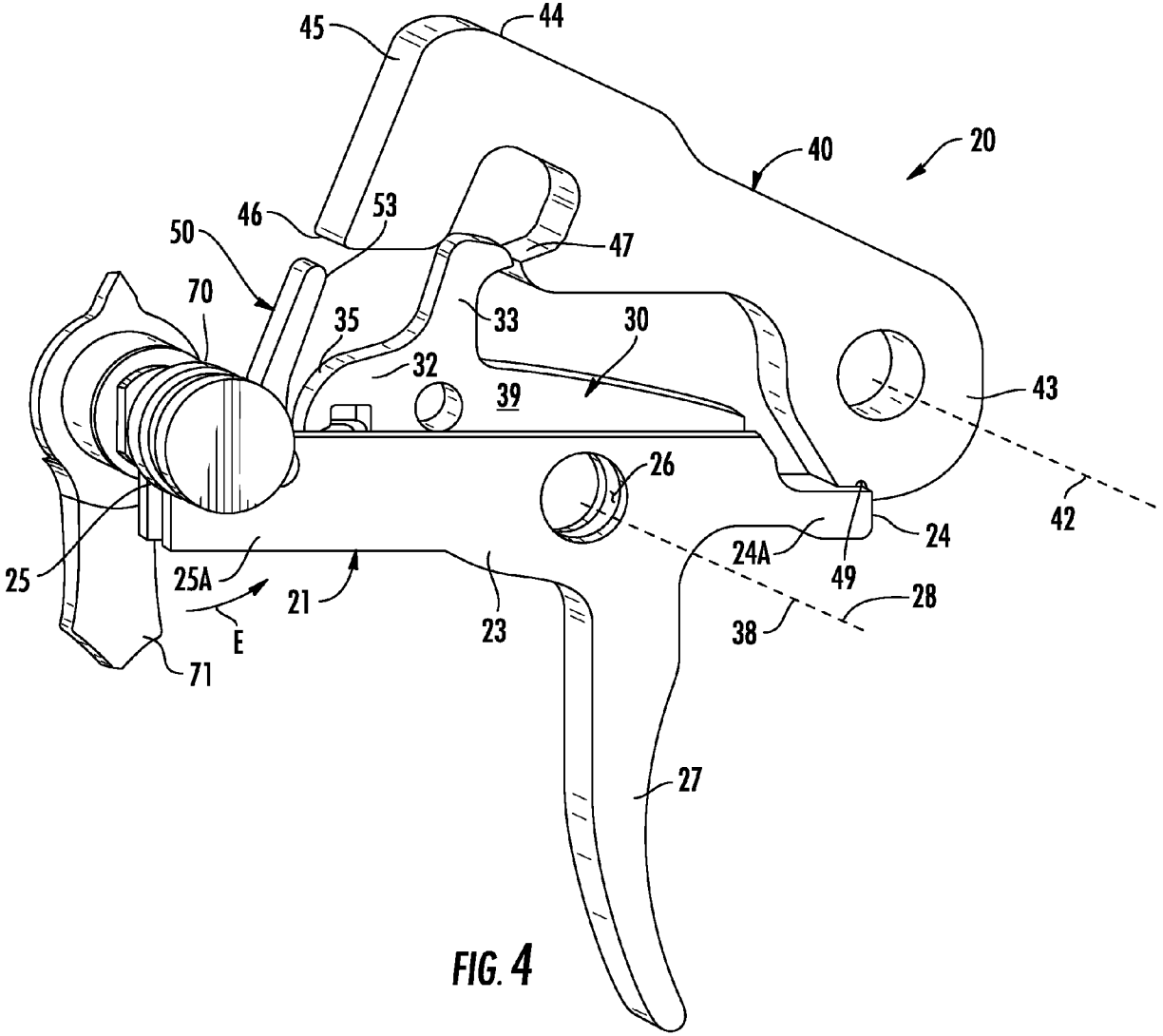
FIG. 4 is a view of the trigger body, the disconnector, the hammer, the assisted reset lever, and the selector of the trigger mechanism of FIG. 1 in a semi-automatic mode of operation.
Figure 6:
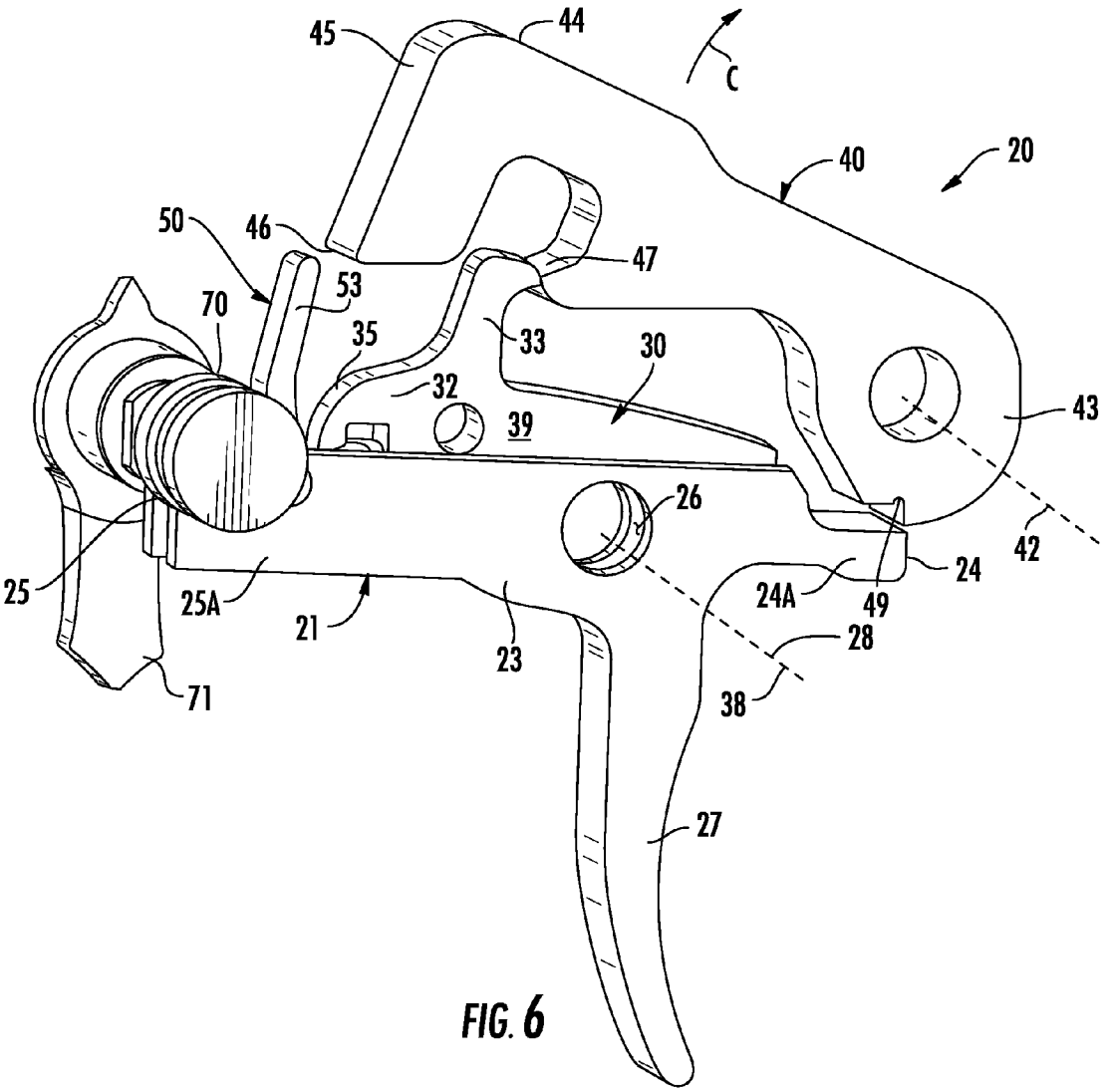
FIGS. 6-9 show a sequence of operation of the trigger body, the disconnector, the hammer, the reset lever, and the selector of the trigger mechanism of FIG. 1 in a semi-automatic mode of operation.
Figure 15:
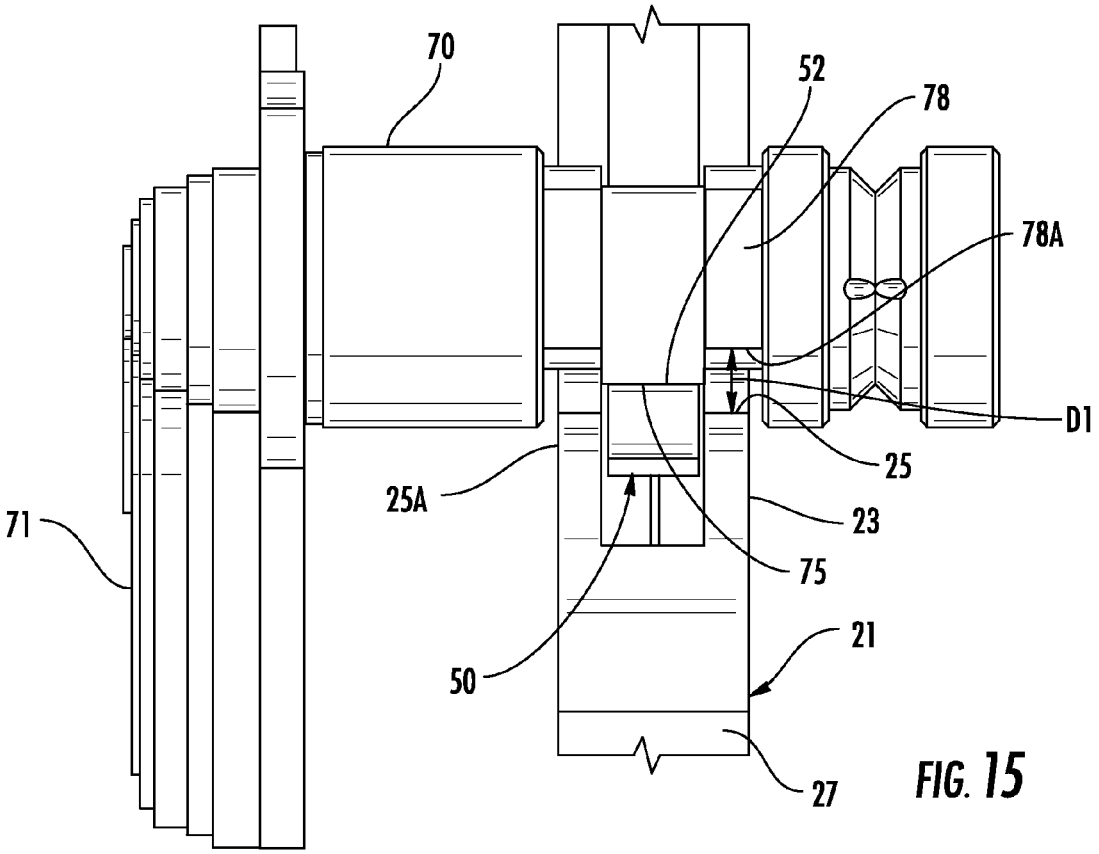
FIG. 15 is a fragmented end elevation view of the trigger mechanism of FIG. 1 illustrating contact between a cam of the selector and the reset lever in the semi-automatic mode of operation of the trigger assembly.
Figure 17:
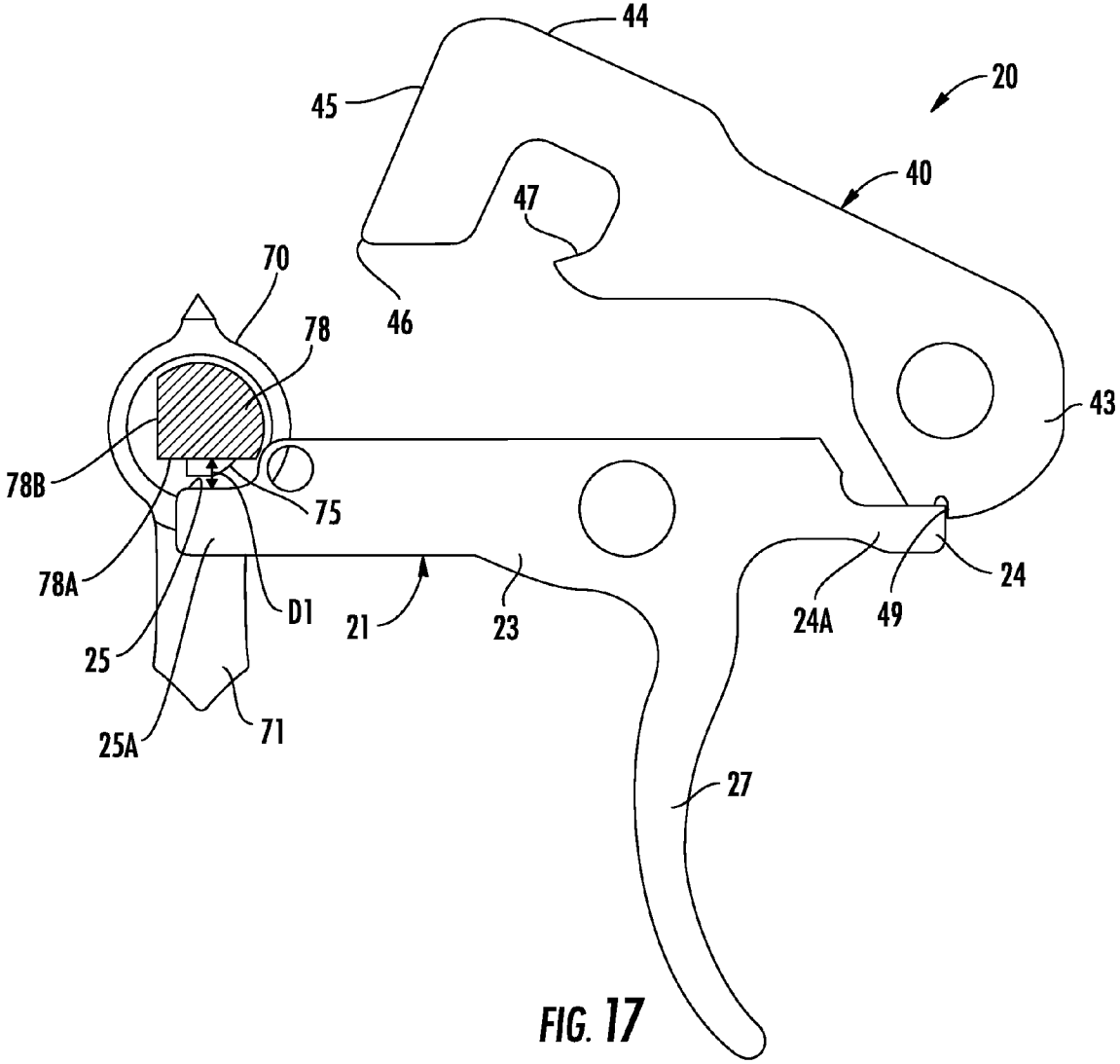
FIG. 17 is a side elevation view of the trigger body, the selector, and the hammer of the embodiment of FIG. 4 illustrating the selector in the semi-automatic mode of operation, and illustrating the trigger body in a set position holding the hammer in a cocked position.
Figure 19:
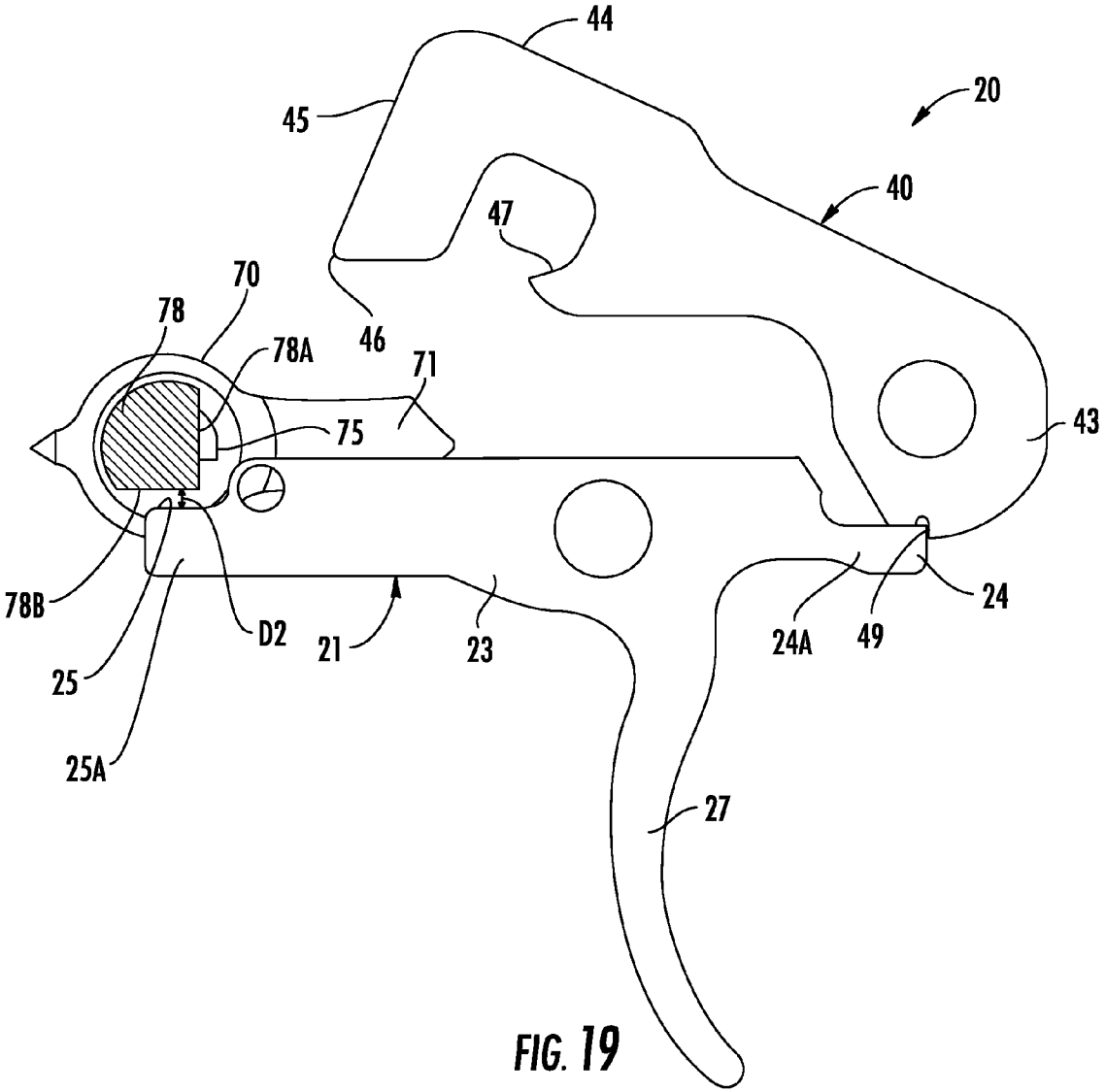
FIG. 19 is a side elevation view of the trigger body, the selector, and the hammer of the embodiment of FIG. 5 illustrating the selector in the assisted reset semi-automatic mode of operation, and illustrating the trigger body in a set position holding the hammer in a cocked position.
Figure 20:
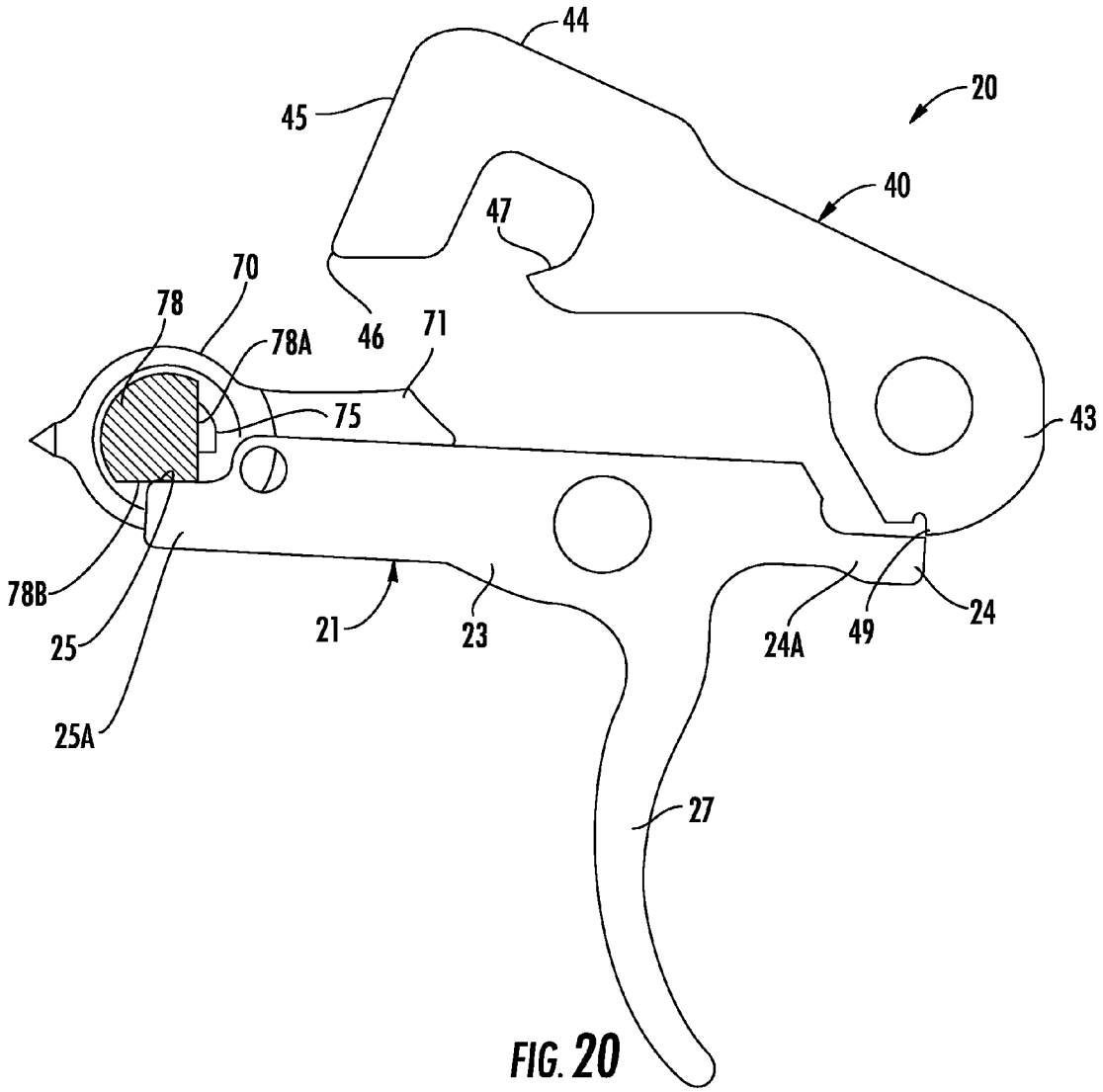
FIG. 20 is a view of the embodiment of FIG. 19 illustrating the trigger body as it would appear in a pulled or fired position and a tail of the trigger body shown as it would appear contacting a second stop of the selector.

Selector 70 is rotated in the direction of arrowed line B in FIG. 1 from the safe mode or safe setting to the semi-automatic mode or semi-automatic setting in FIG. 4 to adjust trigger mechanism 20 from the safe mode of operation as in FIG. 1 to the semi-automatic mode of operation as in FIG. 4. At the same time, cam 75 of selector 70 contacts/abuts/engages arm 52 of reset lever 50, as shown in FIG. 15, so as to act on arm 52 holding reset lever 50 in its inoperative position. For reference purposes, cam 75 is illustrated in FIGS. 17, 19, and 20. As arm 52 is the thing against which cam 75 of selector 70 contacts, arm 52 of reset lever 50 is an abutment of reset lever 50 on or against which cam 75 of selector 70 abuts or contacts. In FIG. 4, selector 70 is in the semi-automatic mode or semi-automatic setting and trigger nose 24 is received in trigger notch 49, holding hammer 40 in the cocked position in preparation for firing. In the semi-automatic mode of operation of trigger mechanism 20 in preparation for firing, trigger disconnector assembly 39 is in a charged or pre-pulled orientation. In this charged or pre-pulled orientation, trigger body 23 and trigger nose 24 are each in a set position. In this set position of trigger body 23, trigger nose 24 at head 24A is received in trigger notch 49 and disconnector hook 33 is in a disengaged position being disengaged from or otherwise relative to hammer disconnect notch 47 formed in hammer 40 between pivot end 43 and striking end 45 allowing forward movement of hammer 40 upon pulling trigger 27. Upon pulling trigger 27 so as to move trigger body 23 and trigger 27 a trigger pull or pulling travel distance in the semi-automatic mode of operation from the set position holding hammer 40 to the pulled or fired position releasing hammer 40, trigger disconnector assembly 39 is pivoted from the charged orientation to a discharged orientation, lowering trigger nose 24 out of trigger notch 49 from the set position to a released position, releasing hammer 40 and moving disconnector hook 33 forwardly from the disengaged position to an engaged position, as shown in FIG. 6, causing hammer 40 pivot forwardly in the direction of arrowed line C to a firing position shown in FIG. 7 to fire a round, while at the same time raising tail 25A of trigger body 23 toward selector 70.

Figure 7:
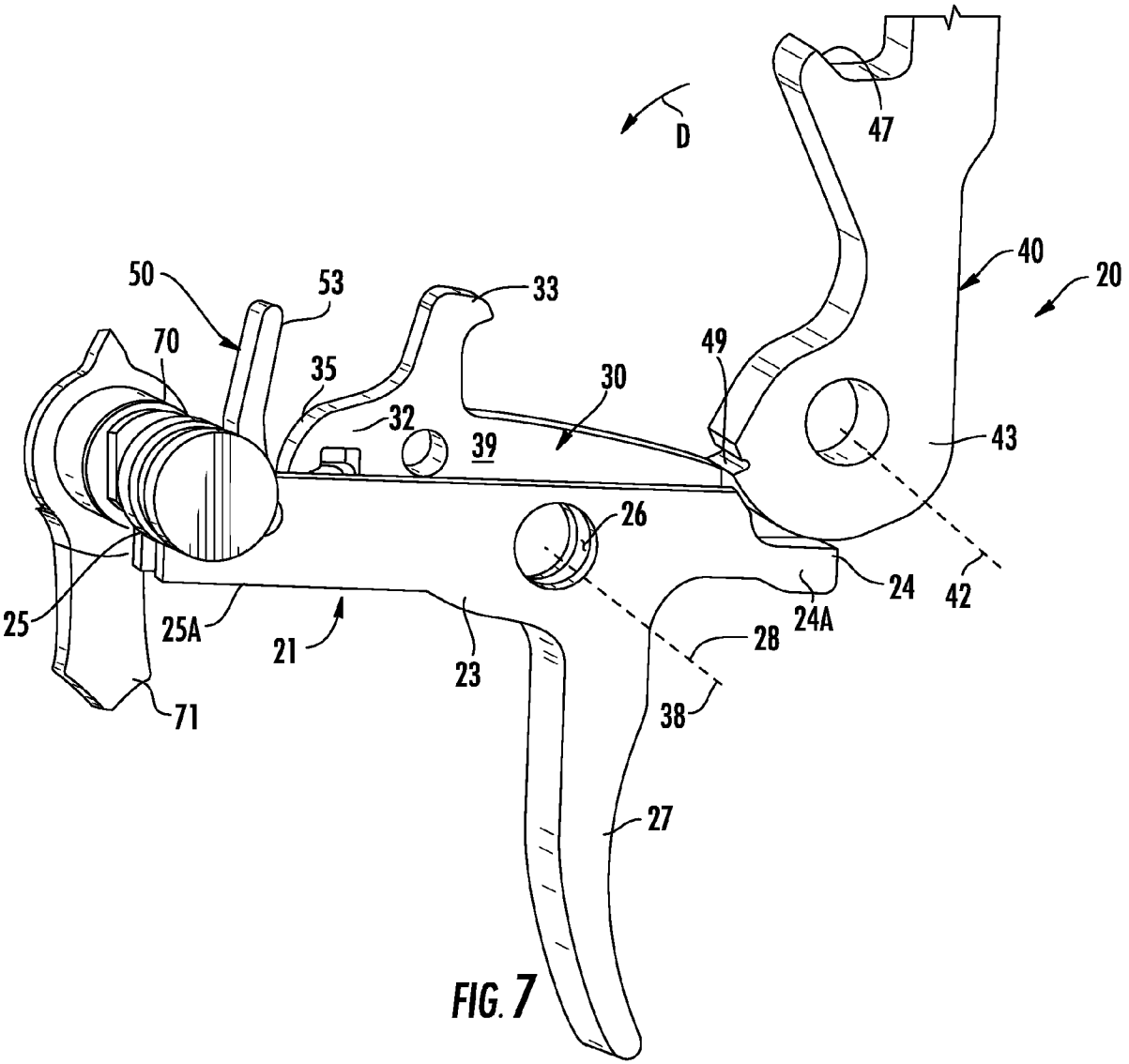
Figure 8:
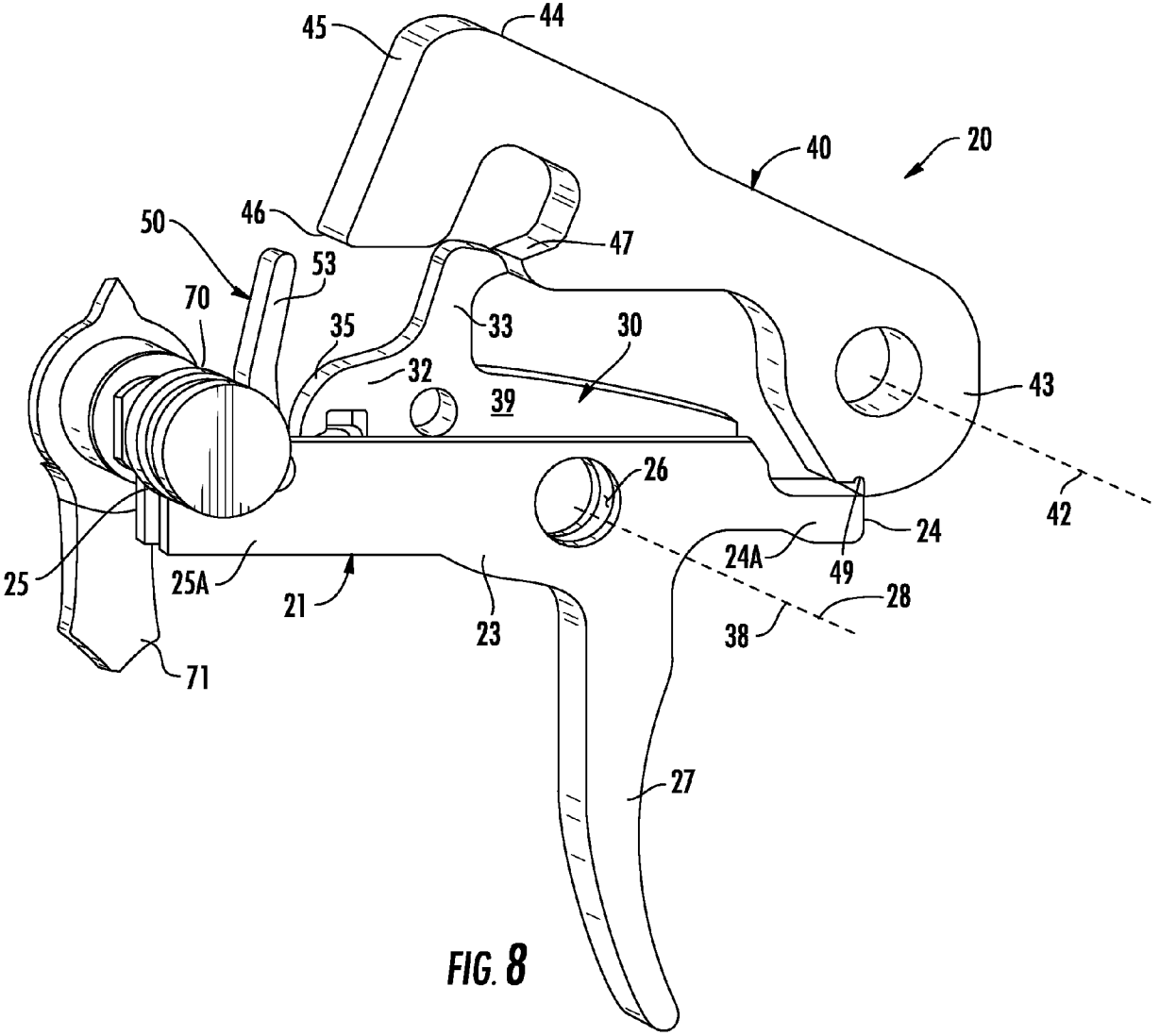
Figure 9:
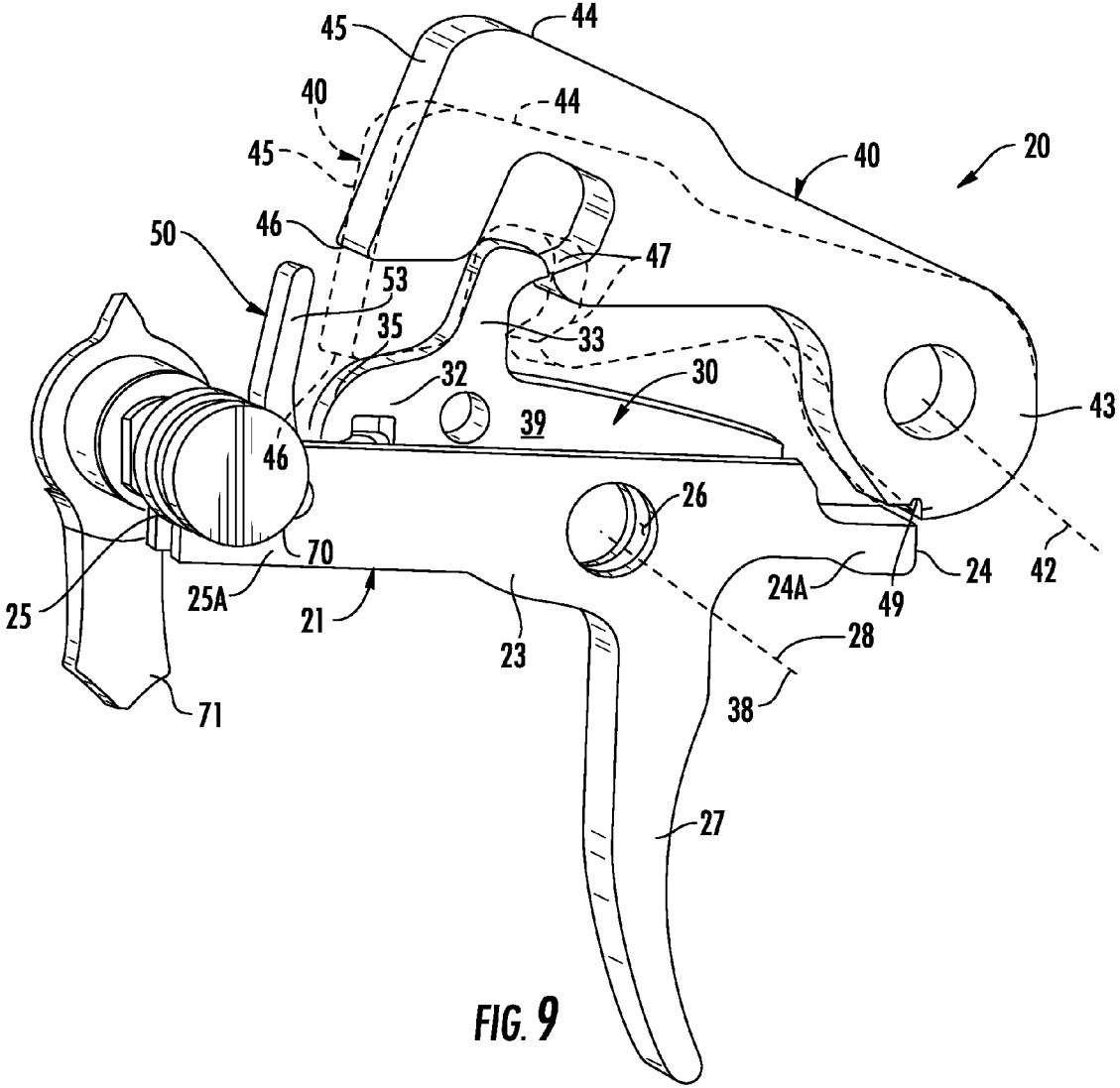

After a round has been fired, the rearwardly moving bolt carrier engages hammer 40 and pivots it rearwardly in the direction of arrowed line D in FIG. 7 toward the cocked position in FIG. 8 and beyond the cocked position to the past-cocked position in FIG. 9. With trigger 27 pulled and held in its pulled or fired position locating disconnector hook 33 in the engaged position as in FIG. 8, hammer disconnect notch 47 of the rearwardly pivoting hammer 40 clips past disconnector hook 33 with a sharp, glancing blow as hammer 40 moves toward and beyond the cocked position in FIG. 8 to the past-cocked position in FIG. 9. In the past-cocked position of hammer 40 and the discharged orientation of trigger disconnector assembly 39 in FIG. 9 with trigger 27 pulled and held in its pulled/fired position, disconnector hook 33 engages hammer disconnect notch 47 in the engaged position of disconnector hook 33 preventing forward movement of hammer 40. Forward movement of hammer 40 is thus arrested by disconnector hook 33 engaging hammer disconnect notch 47. This prevents automatic fire. When trigger 27 is released, trigger body 23 and trigger 27 pivot a trigger reset or resetting travel distance in the semi-automatic mode of operation from the pulled/fired position of trigger body 23 and trigger 27 to the set position of trigger body 23 and trigger 27, whereby trigger disconnector assembly 39 pivots from the discharged orientation to the charged orientation in FIG. 4, in which trigger 27 is moved forwardly, trigger nose 24 at head 24A is raised to its set position received in trigger notch 49, holding hammer 40 in the cocked position, and tail 25A is lowered away from selector 70. At the same time, disconnector hook 33 is pivoted rearwardly from the engaged position to the disengaged position removing it from engagement with hammer disconnect notch 47. Forward movement of hammer 40 is arrested by trigger nose 24 engaging trigger notch 49. Hammer 40 is thus retained in the cocked position by trigger nose 24, preparatory to firing by another trigger pull.

After disconnector hook 33 clips past hammer disconnect notch 47 in response to hammer 40 moving into the past-cocked position beyond the cocked position, hammer 40 over-travels in the past-cocked position, as indicated by the phantom outline of hammer 40 in FIG. 9, misses reset lever 50, including arm 53, in the inoperative position of reset lever 50, and strikes disconnector 30 which in turn imparts the energy from the striking hammer 40 to a rear portion of trigger disconnector assembly 39 of trigger assembly 21, causing trigger disconnector assembly 39 to reset, namely, to pivot from the discharged position to the charged position. Once in the charged position, disconnector hook 33 is in its disengaged position free from interfering with hammer disconnect notch 47 and trigger nose 24 is in its set position in preparation to be received by the trigger notch 49 in the cocked position of hammer 40. As hammer 40 then pivots forwardly from the past-cocked position toward the cocked position, hammer disconnect notch 47 passes by disconnector hook 33 and trigger nose 24 is received trigger notch 49, holding hammer 40 in the cocked position preparatory to firing by another trigger 27 pull. In the inoperative position of reset lever 50 in the semi-automatic mode of operation of trigger mechanism 20, selector 70 holds reset lever 50 out-of-play away from hammer 40 preventing hammer 40 from contacting/striking or otherwise interacting with reset lever 50 during semi-automatic firing.

FIG. 17 is a side elevation view of trigger body 23, selector 70, and hammer 40 oriented as in FIG. 4 illustrating selector 70 in the semi-automatic mode of operation, and illustrating trigger body 23 in the set position holding hammer 40 in the cocked position. Disconnector 30 is not shown in FIG. 17, but is referenced in the figures described above. Selector 70 has a stop body 78. Stop body 78 is located near, above, and opposite to, notch 25 of tail 25A of trigger body 23. Stop body 78 includes two stops, including stop 78A and stop 78B. Stops 78A and 78B are surfaces of stop body 78. Here, stops 78A and 78B are perpendicular relative to each other.

In a first position of selector 70 corresponding to the semi-automatic mode of operation of selector 70 as in FIG. 17, stop 78A is registered with, meaning aligned with, tail 25A, specifically notch 25 of tail 25A. With trigger nose 24 received in trigger notch 49 holding hammer 40 in the cocked position in preparation for firing, a distance D1 is defined between semi-automatic stop 78A and tail 25A, specifically notch 25 of tail 25A. Again, in the semi-automatic mode of operation of trigger mechanism 20 in preparation for firing trigger body 23 and trigger nose 24 are each in a set position, and in this set position of trigger body 23 trigger nose 24 at head 24A is received in trigger notch 49 in preparation for pulling trigger 27 to release hammer 40. Upon pulling trigger 27 so as to move trigger body 23 and trigger 27 the trigger pulling travel distance in the semi-automatic mode of operation from the set position holding hammer 40 to the pulled/fired position releasing hammer 40, trigger nose 24 is lowered out of trigger notch 49 from the set position to a released position, releasing hammer 40, while at the same time raising tail 25A of trigger body 23 toward stop 78A of stop body 78 of selector 70 closing distance D1 between notch 25 of tail 25A of trigger body 23 so as to bring notch 25 of tail 25A of trigger body 23 into direct contact against stop 78A of stop body 78. Upward movement of tail 25A of trigger body 23 is thus arrested by notch 25 of tail 25A contacting stop 78A of stop body 78 which, in turn, arrests movement of trigger body 23, or in other words limits or otherwise arrests the pivotal movement of trigger 27 and trigger body 23 past the pulled/fired position in the semi-automatic mode of operation. Trigger body 23 and trigger 27 in turn move the trigger reset travel distance in the semi-automatic mode of operation from the pulled position to the set position to hold hammer 40 in the cocked position preparatory to firing another round as described above. In the semi-automatic mode of operation of trigger mechanism 20, the trigger pulling and trigger reset travel distances of trigger body 23 and trigger 27 are equal.

Figure 5:
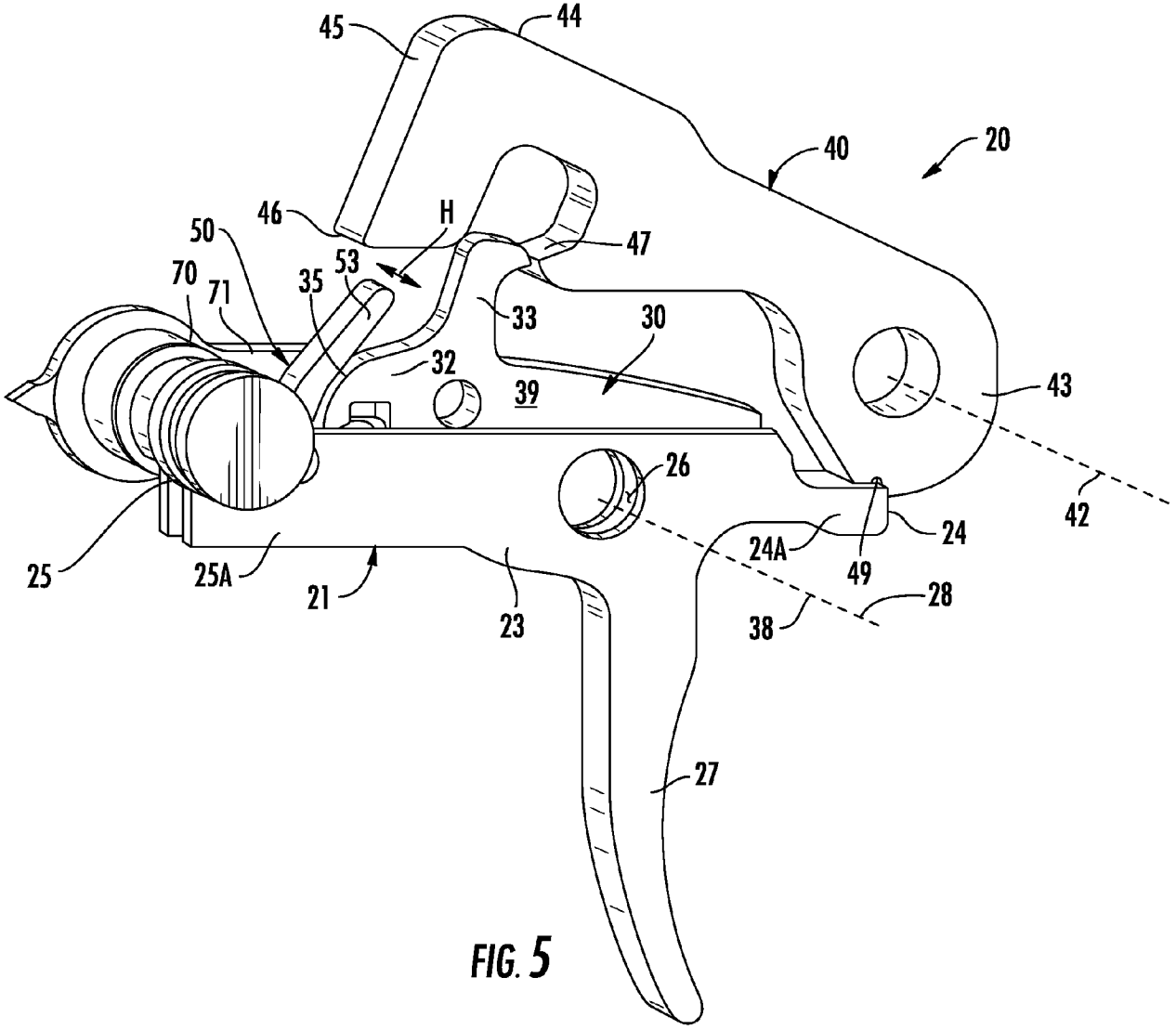
FIG. 5 is a view similar to that of FIG. 4 illustrating the trigger mechanism as it would appear in an assisted reset semi-automatic mode of operation.
Figure 16:
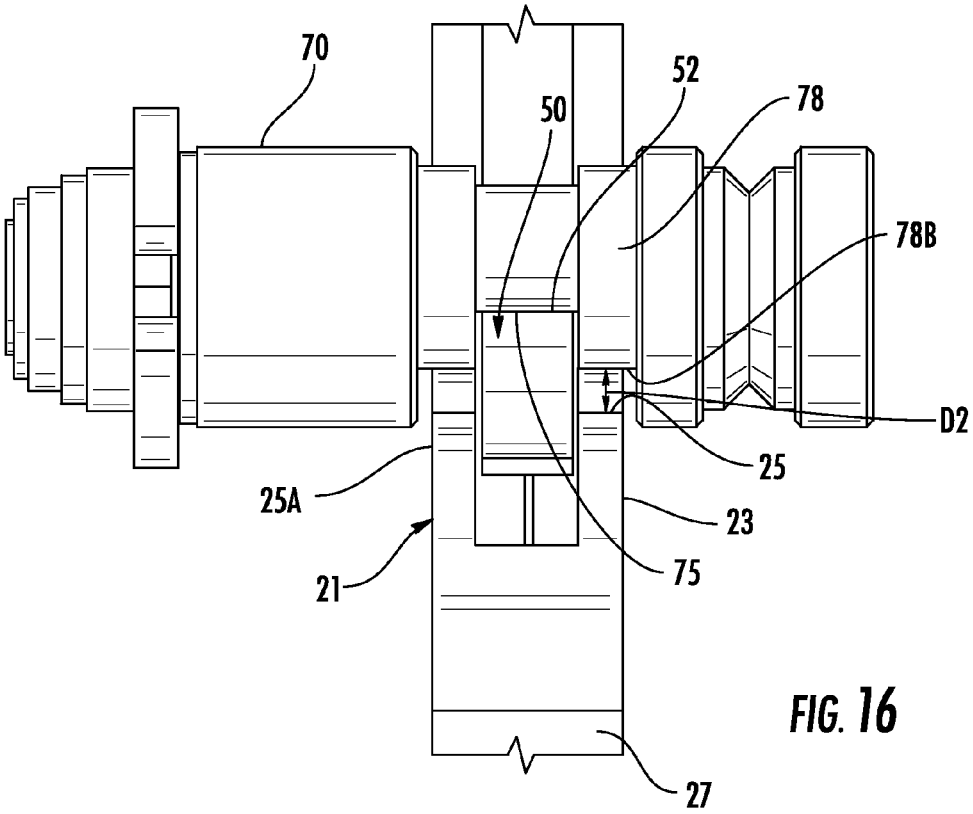
FIG. 16 is a fragmented end elevation view of the trigger mechanism of FIG. 1 illustrating contact between a cam of the selector and the reset lever in the assisted-reset semi-automatic mode of operation of the trigger assembly.

Assisted-reset semi-automatic firing is achieved by utilizing selector 70, which is rotated in the direction of arrowed line E in FIG. 4 from the semi-automatic mode or semi-automatic setting to the assisted-reset semi-automatic mode or assisted-reset semi-automatic setting in FIG. 5 to adjust trigger mechanism 20 from the semi-automatic mode of operation as in FIG. 4 to the assisted-reset semi-automatic mode of operation as in FIG. 5. At the same time, cam 75 of selector 70 contacts/abuts/engages arm 52, as seen in FIG. 16, so as to act on arm 52 of reset lever 50 pivoting reset lever 50 from its inoperative position defining the inoperative position of arm 53 to its operative position defining the operative position of arm 53, resulting in the movement of arm 53 from the aft or rearward upright position toward selector 70 and away from cam surface 35 of disconnector 30 to the fore of forward upright position away from selector 70 and toward and in contact against cam surface 35 of disconnector lever 32 of disconnector 30 of trigger disconnector assembly 39. The constant tension on reset lever 50 provided by reset lever spring 60 constantly biasing/urging/tensioning reset lever 50 from its inoperative position relative to trigger disconnector assembly 39 to its operative position relative to trigger disconnector assembly 39 pivots reset lever from its inoperative position to its operative position in response to cam 75 acting on arm 52 in response to rotation of selector 70 from its semi-automatic mode or semi-automatic setting to its assisted-reset semi-automatic mode or assisted-reset semi-automatic setting.

The contact between cam surface 35 and arm 53 of reset lever 50 is a mechanical coupling. This mechanical coupling defines a mechanical communication between arm 53 of reset lever 50 and trigger disconnector assembly 39 and, more specifically, between arm 53 of reset lever 50 and disconnector 30 and, still more specifically, between arm 53 of reset lever 50 and disconnector lever 32 of disconnector 30 and, yet still more specifically, between arm 53 of reset lever 50 and cam surface 35 of disconnector lever 32 of disconnector 30 of trigger disconnector assembly 39, all according to various aspects of the invention. As a result of the contact between cam surface 35 and arm 53, trigger disconnector assembly 39 is in mechanical communication with reset lever 50, disconnector 30 is in mechanical communication with reset lever 50, disconnector lever 32 is in mechanical communication with reset lever 50, and cam surface 35 is in mechanical communication with reset lever 50. As arm 53 is the thing that engages cam surface 35 in the operative position of reset lever, arm 53 of reset lever 50 is an abutment of reset lever 50 that contacts cam surface 35 in the operative position of reset lever 50.

In the inoperative position of reset lever 50 in the semi-automatic mode of operation of trigger mechanism 20, reset lever 50 is out of play, whereby hammer 40 does not contact or otherwise strike or interact with reset lever 50 during semi-automatic firing. In the operative position of reset lever 50, reset lever 50 is in play being operatively coupled to hammer tail 46 of striking end 45 of hammer 40, wherein reset lever 50 is positioned to be contacted or struck by hammer tail 40 of striking end 45 of hammer 40 in the past-cocked position of hammer 40 during assisted-reset semi-automatic firing.

Figure 10:
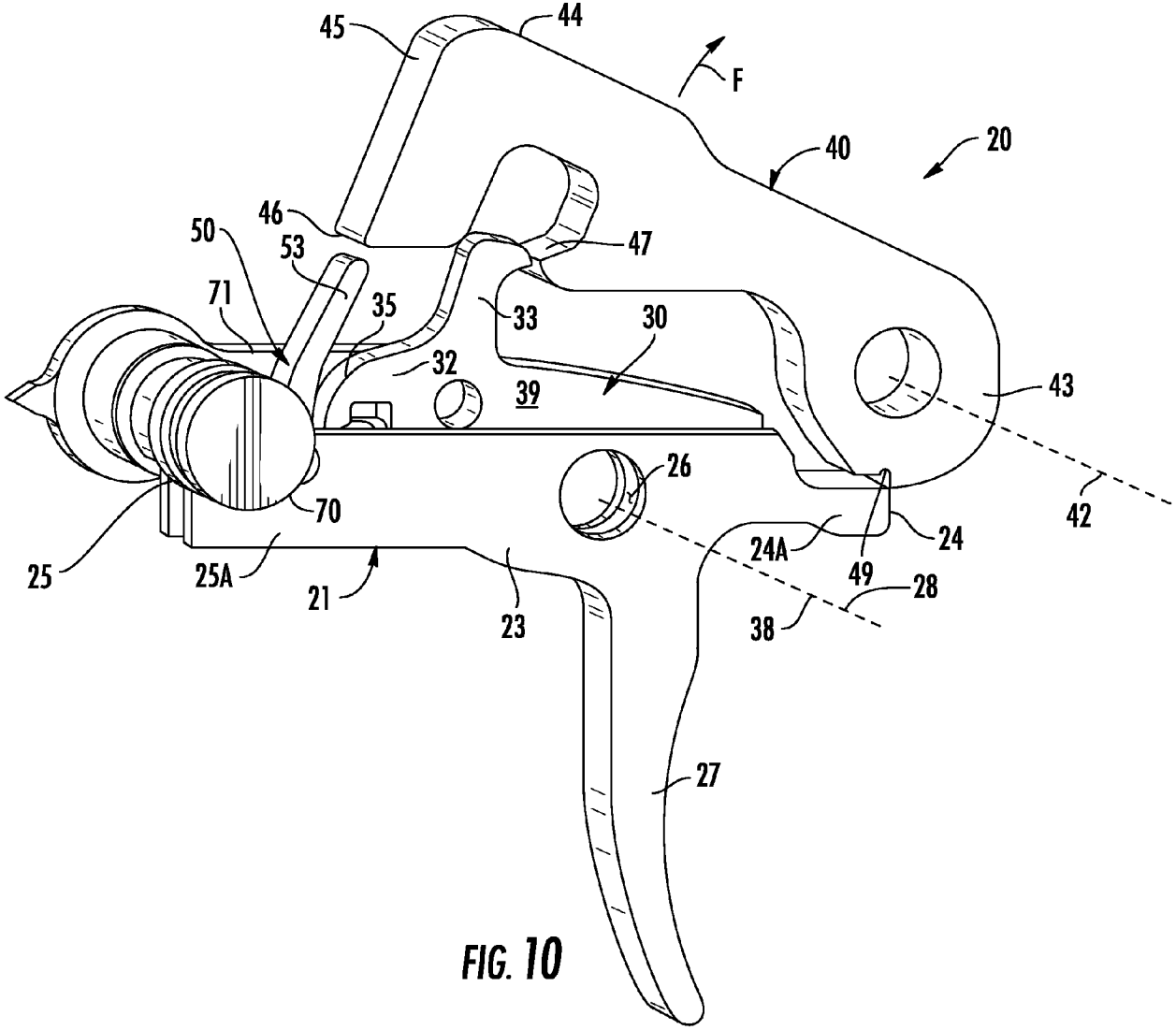
FIGS. 10-14 show a sequence of operation of the trigger body, the disconnector, the hammer, the reset lever, and the selector of the trigger mechanism of FIG. 1 in an assisted-reset semi-automatic mode of operation.

In FIG. 5, selector 70 is in the assisted-reset semi-automatic mode or assisted-reset semi-automatic setting and trigger nose 24 of head 24A is received in trigger notch 49, holding hammer 40 in the cocked position in preparation for firing. In the assisted-reset semi-automatic mode of operation of trigger mechanism 20, trigger disconnector assembly 39 is a charged or pre-pulled orientation. In this charged or pre-pulled orientation, trigger body 23 and trigger nose 24 at head 24A are each in a set position. In this set position of trigger body 23, trigger nose 24 at head 24A received in trigger notch 49 and disconnector hook 33 is in the disengaged position being disengaged relative to hammer disconnect notch 47, allowing forward movement of hammer 40 upon pulling trigger 27. Upon pulling trigger 27 so as to move trigger body 23 a trigger pulling or pull travel distance in the assisted-reset mode of operation from its set position holding hammer 40 to its pulled/fired position in the assisted-reset semi-automatic mode of operation releasing hammer 40, trigger disconnector assembly 39 is pivoted from the charged orientation to the discharged orientation, lowering trigger nose 24 out of trigger notch 49 from the set position to a released position, releasing hammer 40 and moving disconnector hook 33 forwardly from the disengaged position to an engaged position, as shown in FIG. 10, causing hammer 40 pivot forwardly in the direction of arrowed line F to a firing position shown in FIG. 11 to fire a round, while at the same time raising tail 25A of trigger body 23 toward selector 70.

Figure 11:
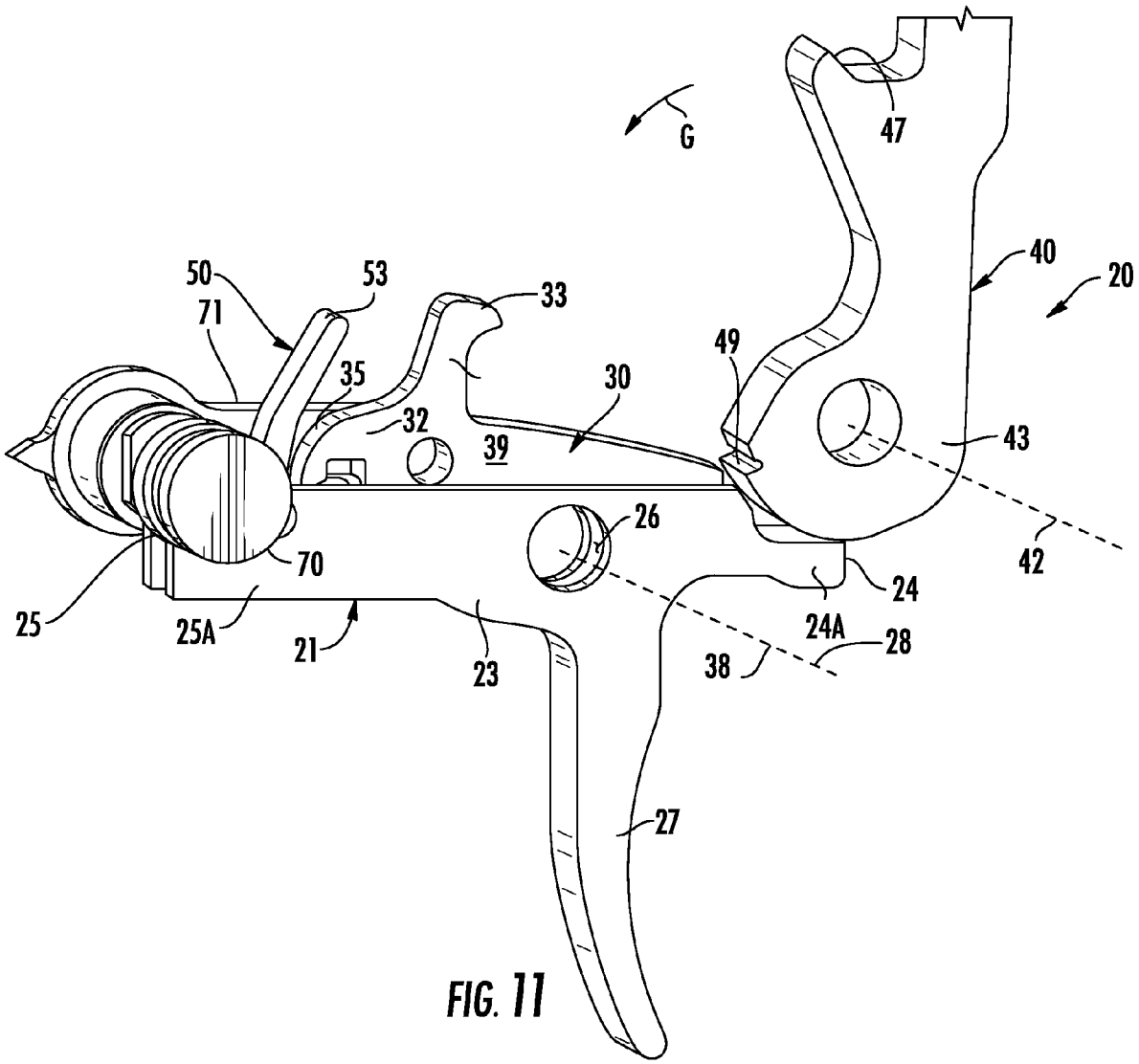
Figure 12:
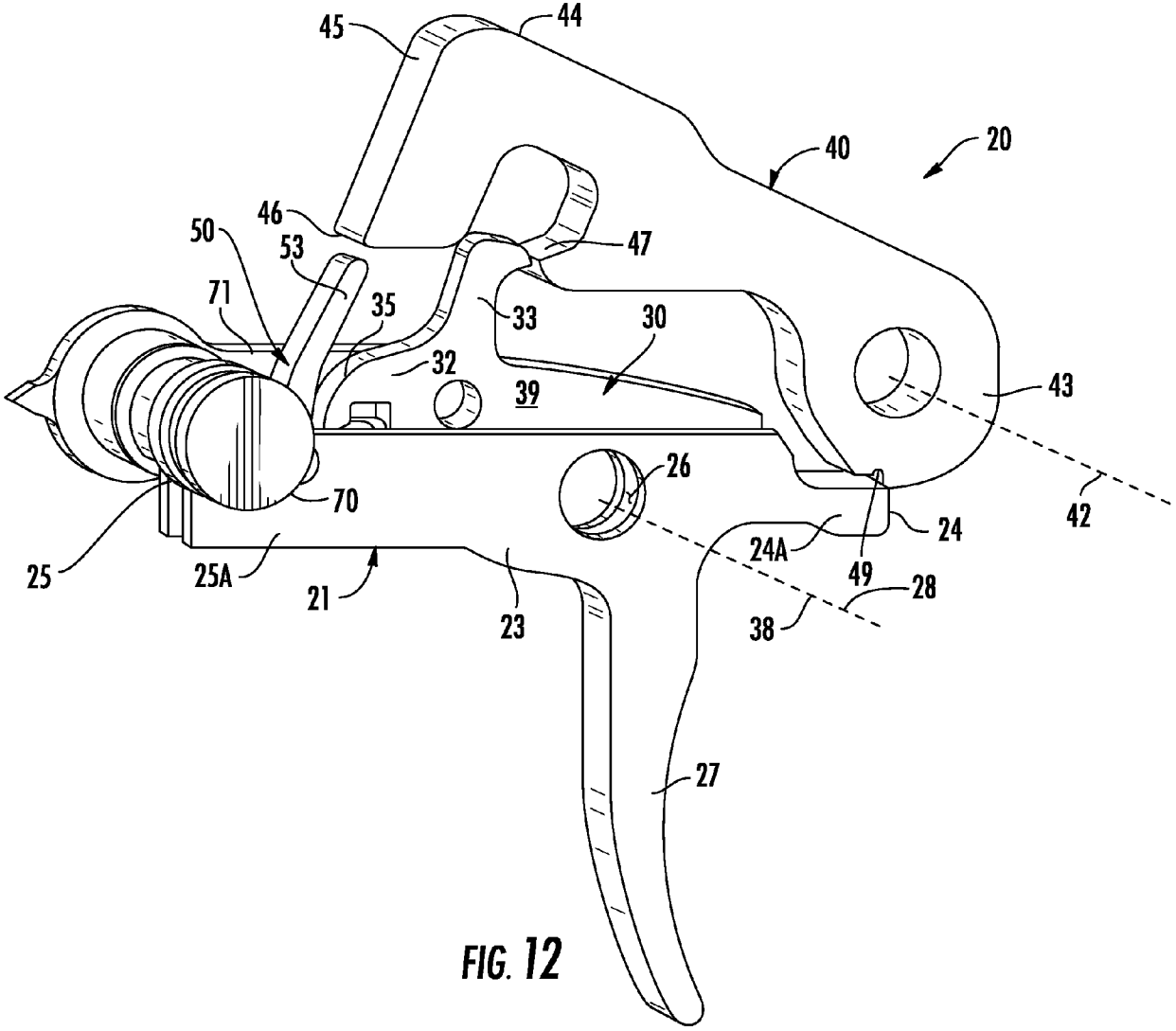
Figure 13:
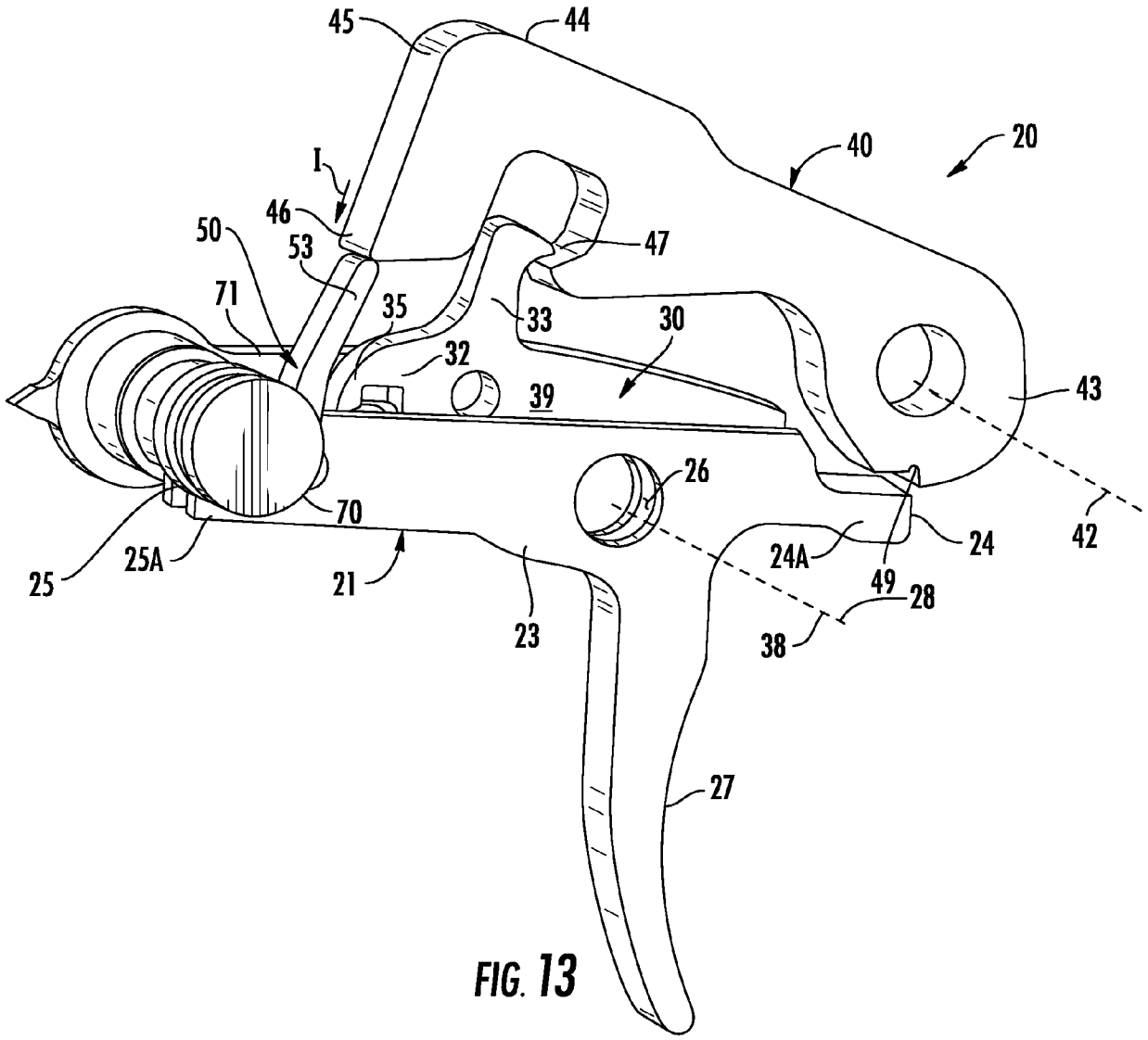

After a round has been fired, the rearwardly moving bolt carrier engages hammer 40 and pivots it rearwardly in the direction of arrowed line G in FIG. 11 toward the cocked position in FIG. 12 and beyond the cocked position to the past-cocked position in FIG. 13. With trigger 27 pulled and held in its pulled/fired position locating disconnector hook 33 in the engaged position as in FIG. 12, hammer disconnect notch 47 of the rearwardly pivoting hammer 40 clips past disconnector hook 33 with a sharp, glancing blow as hammer moves toward and beyond the cocked position in FIG. 12 to the past-cocked position in FIG. 13. In the past-cocked position of hammer 40 and the discharge orientation of trigger disconnector assembly 39 in FIG. 13 with trigger 27 pulled and held in its pulled/fired position, disconnector hook 33 is positioned to engage hammer disconnect notch 47 in the engaged position of disconnector hook 33 for preventing forward movement of hammer 40. Forward movement of hammer 40 is thus arrested by disconnector hook 33 engaging hammer disconnect notch 47. This prevents automatic fire. When trigger 27 is released, trigger body 23 and trigger 27 pivot a trigger resetting or reset travel distance in the assisted-reset semi-automatic mode of operation from the pulled position of trigger body 23 and trigger 27 to the set position of trigger body 23 and trigger 27, whereby trigger disconnector assembly 39 pivots from the discharged orientation to the charged orientation in FIG. 5, in which trigger 27 is moved forwardly, trigger nose 24 at head 24A is moved to its set position received in trigger notch 49, holding hammer 40 in the cocked position, and tail 25A is lowered away from selector 70. At the same time, disconnector hook 33 is pivoted rearwardly from the engaged position to the disengaged position removing it from engagement with hammer disconnect notch 47. Forward movement of hammer 40 is arrested by trigger nose 24 engaging trigger notch 49. Hammer 40 is thus retained in the cocked position by trigger nose 24, preparatory to firing by another trigger pull.

Reset lever 50 pivots at pivot 56 between inoperative and operative positions relative to cam surface 35 of disconnector lever 32 of disconnector 30 of trigger disconnector assembly 39. The constant tension applied by reset lever spring 60 (FIGS. 2 and 3) keeps constant tension on reset lever 50 constantly urging/biasing reset lever 50 into its operative position in the assisted-reset semi-automatic mode or setting of selector 70, in accordance with the principle of the invention. In response to movement of reset lever 50 from its inoperative position to its operative position in response to movement of selector 70 to the assist-reset semi-automatic setting from either of the safe setting or the semi-automatic setting of selector 70, arm 53 moves from the inoperative position thereof as in FIG. 4 to the operative position thereof as in FIG. 5 in direct contact against cam surface 35 of disconnector lever 32 of disconnector 30 of trigger disconnector assembly 39. This contact of arm 53 of reset lever 50 directly against cam surface 35 is a mechanical coupling that forms the mechanical communication as discussed and defined above.

In the inoperative position of arm 53, arm 53 is pivoted rearwardly with respect to cam surface 35 and trigger disconnector assembly 39 in the direction of selector 70, and is spaced-apart from, and not in contact with, cam surface 35 of disconnector lever 32 of disconnector 30. In the operative position of arm 53, arm 53 is pivoted in the opposite direction forwardly with respect to cam surface 35 of disconnector lever 32 of disconnector 30 of trigger disconnector assembly 39 in the direction of pivot 28 and into direct contact against cam surface 35 of disconnector lever 32 of disconnector 30 of trigger disconnector assembly 39. And so in the inoperative position of reset lever 50, arm 53 is also in an inoperative position and is made to extend upright and rearward toward selector 70 and away from hammer tail 46 of hammer 40 in the cocked position of hammer 40, and in this position cannot be contacted or struck by hammer tail 46 of striking end 45 of hammer 40 during semi-automatic firing. As such, hammer 40 misses reset lever 50, including arm 53, as hammer 40 travels downwardly in the past-cocked position. In the operative position of reset lever 50, arm 53 is also in an operative position and is made to extend upright and forward from selector 70 toward hammer tail 46 of hammer 40 in the cocked position of hammer 40, and in this position is operatively coupled to hammer tail 46 of hammer 40, wherein arm 53 of reset lever 50 is positioned to be contacted or struck by hammer tail 46 of striking end 45 of hammer 40 in the past-cocked position of hammer 40 during assisted-reset semi-automatic firing. Again, because the constant tension applied by reset lever spring 60 (FIGS. 2 and 3) keeps constant tension on reset lever 50 constantly urging/biasing reset lever 50 toward its operative position in the assisted-reset semi-automatic mode or setting of selector 70, the constant tension applied by reset lever spring 60 tends to hold reset lever 50 in its operative position in the assisted-reset semi-automatic mode of operation.

In the operative position of reset lever 50 as explained above, arm 53 is in contact with cam surface 35 of disconnector lever 32 of disconnector 30 of trigger disconnector assembly 39, and this contact persists or is otherwise maintained by reset lever spring 60 constantly acting on reset lever 50 during the pivoting movement of trigger disconnector assembly 39 between its charged and discharged positions. Cam surface 35 acts against arm 53 in response to movement of trigger disconnector assembly 39 between its charged and discharged positions. This contact interaction between cam surface 35 and arm 53 in the operative position of reset lever 50 moves reset lever 50 in the direction of double arrowed line H in FIG. 5 toward the inoperative position of reset lever 50 to an open position of reset lever 50 in the discharged position of trigger disconnector assembly 39 as in FIG. 10, and in the opposite direction away from the inoperative position of reset lever 50 to a closed position of reset lever in the charged position of trigger disconnector assembly 50 as in FIG. 5. And so in the operative position of reset lever 50, reset lever 50 moves between its open and closed positions relative to trigger disconnector assembly 39 and, more particular, relative to cam surface 35 of disconnector lever 32 of disconnector 30 of trigger disconnector assembly 39, in response to movement of trigger disconnector assembly 39 between the discharged and charged positions. In the operative position of reset lever 50, reset lever spring 60 keeps constant tension on reset lever 50 constantly urging/biasing reset lever 50 from its open position toward its closed position in the assisted-reset semi-automatic mode or setting of selector 70, and the constant tension applied by reset lever spring 60 thus tends to hold reset lever 50 in its closed position in the assisted-reset semi-automatic mode of operation. At the same time, reset lever 50 remains in its operative position in both its open and closed positions in the discharged and charged positions of trigger disconnector assembly 39 in the assisted-reset semi-automatic mode of operation of trigger assembly 20, in accordance with the principle of the invention.

The open position of reset lever 50 in the operative position of reset lever 50 is an open position of arm 53, and the closed position of reset lever 50 in the operative position of reset lever 50 is a closed position of arm 53. In response to movement of reset lever 50 between its open and closed positions in response to movement of trigger disconnector assembly 39 between its discharged and charged positions, arm 53, in turn, moves between open and closed positions relative to trigger disconnector assembly 39 and, more particular, relative to cam surface 35 of disconnector lever 32 of disconnector 30 of trigger disconnector assembly 39. In the open position of arm 53, arm 53 is pivoted rearwardly and upwardly with respect to cam surface 35 of disconnector lever 32 of disconnector 30 of trigger disconnector assembly 39 in the direction of selector 70. In the closed position of arm 53, arm 53 is pivoted forwardly and downwardly from the open position thereof with respect to cam surface 35 of disconnector lever 32 of disconnector 30 of trigger disconnector assembly 39 in the direction of pivot 28. Because reset lever spring 60 keeps constant tension on reset lever 50 constantly urging/biasing reset lever 50 from its open position toward its closed position in the assisted-reset semi-automatic mode or setting of selector 70, the constant tension applied by reset lever spring 60 thus tends to hold arm 53 in its closed position in the assisted-reset semi-automatic mode of operation. At the same time, arm 53 remains in its operative position in both its open and closed positions in the discharged and charged positions of trigger disconnector assembly 39 in the assisted-reset semi-automatic mode of operation of trigger assembly 20.

Figure 14:
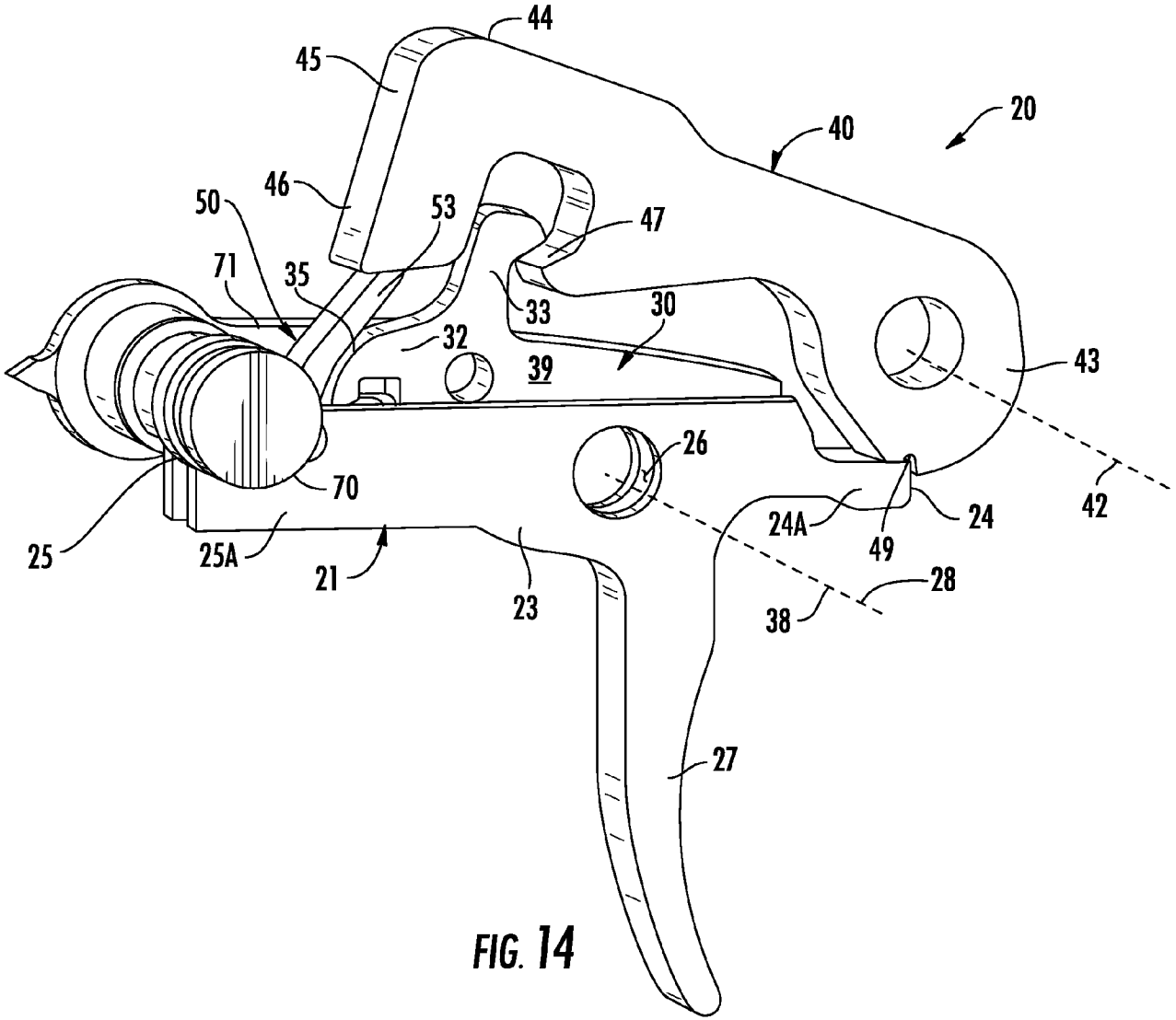

In the operation of reset lever 50 in the assisted-reset semi-automatic mode of operation of trigger mechanism 20, after a round has been fired rearwardly moving bolt carrier engages hammer 40 and pivots it rearwardly in the direction of arrowed line G in FIG. 11 toward the cocked position in FIG. 12 and beyond the cocked position to the past-cocked position in FIG. 13. With trigger 27 pulled and held in its pulled/fired position as in FIG. 13, as hammer 40 moves beyond the cocked position to the past-cocked position in FIG. 13, hammer disconnect notch 47 of the rearwardly pivoting hammer 40 clips past disconnector hook 33 with a sharp, glancing blow as hammer 40 moves toward and beyond the cocked position in FIG. 12 to the past-cocked position in FIG. 13, hammer tail 46 of striking end 45 of hammer 40 encounters/strikes arm 53 of reset lever 50 as shown in FIG. 13, in this example at a location above cam surface 35 and, moreover, between cam surface 35 of disconnector lever 32 and disconnector hook 33, which in turn imparts the energy from the striking hammer 40 to arm 53 of reset lever 50. This, in turn, pivots reset lever 50 from the open position to the closed position at the same time moving arm 53 from the open position in FIG. 13 to the closed position in FIG. 14 as hammer 40 over-travels downwardly in the direction of arrowed line I in FIG. 13 in the past-cocked position. At the same time, arm 53 of reset lever 50 engages cam surface 35 of disconnector lever 32 of disconnector 30 of trigger disconnector assembly 39 which in turn imparts the energy from the pivoting reset lever 50 to disconnector 30 of disconnector assembly 39, whereby arm 53 acts on cam surface 35 pivoting trigger disconnector assembly 39, including trigger body 23 at pivot 28 and disconnector 30 at pivot point 38 concurrent with pivot 28, from the discharged orientation to the charged orientation when arm 53 moves via the pivoting of reset lever 50 from the open position to the closed position, raising trigger nose 24 of head 24A to its set position in preparation to be received by trigger notch 49 in the cocked position of hammer 40 and to position disconnector 30 in the disengaged position of disconnector hook 33 relative to hammer disconnect notch 49, as shown in FIG. 14, while at the same time lowering tail 25A of trigger body 23 away from selector 70. At the same time, disconnector hook 33 is pivoted rearwardly from the engaged position to the disengaged position removing it from engagement with hammer disconnect notch 47. Forward movement of hammer 40 is arrested by trigger nose 24 engaging trigger notch 49. Hammer 40 is thus retained in the cocked position by trigger nose 24, preparatory to firing by another trigger pull. And so in the assisted-reset semi-automatic mode of operation of trigger mechanism 20 trigger disconnector assembly 39 is in mechanical communication with reset lever 50, whereby movement of reset lever 50 from its open position to its closed position via the action of hammer 40 urges/imparts corresponding movement of disconnector assembly 39 from the discharged orientation to the charged orientation.

According then to the principle of the invention, in the assisted-reset semi-automatic mode of operation of trigger mechanism 20 trigger disconnector assembly 39 is in mechanical communication with reset lever 50. Striking end 45 of hammer 40 strikes reset lever 50 in the past-cocked position of hammer 40 pivoting reset lever 50 from the open position to the closed position, and reset lever 50 in turn acts on trigger disconnector assembly 39 to pivot trigger disconnector assembly 39 from the discharged orientation to the charged orientation when reset lever 50 moves from the open position to the closed position, to position trigger nose 24 in the set position in preparation to be received by trigger notch 49 in the cocked position of hammer 40 and to position disconnector 30 in the disengaged position of disconnector hook 33 relative to hammer disconnect notch 47, and to lower tail 25A of trigger body 23 away from selector 70.

In another aspect according to the principle of the invention, in the assisted-reset semi-automatic mode of operation of trigger mechanism 20 cam surface 35 of trigger disconnector 39 assembly is in mechanical communication with reset lever 50. Hammer tail 46 of striking end 45 of hammer 40 strikes reset lever 50 in the past-cocked position hammer 40 pivoting reset lever 50 from the open position to the closed position, and reset lever 50 in turn acts on cam surface 35 to pivot trigger disconnector assembly 39 from the discharged orientation to the charged orientation when reset lever 50 moves from the open position to the closed position, to position trigger nose 24 in the set position in preparation to be received by trigger notch 49 in the cocked position of hammer 40 and to position disconnector 30 in the disengaged position of disconnector hook 33 relative to hammer disconnect notch 47, and to lower tail 25A of trigger body 23 away from selector 70.

In yet another aspect according to the principle of the invention, in the assisted-reset semi-automatic mode of operation of trigger mechanism 20 disconnector 30 is in mechanical communication with reset lever 50. Striking end 45 of hammer 40 strikes reset lever 50 in the past-cocked position of hammer 40 pivoting reset lever 50 from the open position to the closed position, and reset lever 50 in turn acts on disconnector 30 to concurrently pivot disconnector 30 from the engaged position of disconnector hook 33 to the disengaged position of disconnector hook 33 and trigger body 23 from the released position of trigger nose 24 to the set position of trigger nose 24 in preparation to be received by trigger notch 49 in the cocked position of hammer 40 while at the same time lowering tail 25A of trigger body 23 away from selector 70.

In yet still another aspect according to the principle of the invention, in the assisted-reset semi-automatic mode of operation of trigger mechanism 20 disconnector lever 32 of disconnector 30 is in mechanical communication with reset lever 50. Striking end 45 of hammer 40 strikes reset lever 50 in the past-cocked position of hammer 40 pivoting reset lever 50 from the open position to the closed position, and reset lever 50 in turn acts on disconnector lever 32 to concurrently pivot disconnector 30 from the engaged position of disconnector hook 33 to the disengaged position of disconnector hook 33 and trigger body 23 from the released position of trigger nose 24 to the set position of trigger nose 24 in preparation to be received by trigger notch 49 in the cocked position of hammer 40 while at the same time lowering tail 25A of trigger body 23 away from selector 70.

In still a further aspect according to the principle of the invention, in the assisted-reset semi-automatic mode of operation of trigger mechanism 20 cam surface 35 of disconnector 30 is in mechanical communication with reset lever 50. Striking end 45 of hammer 40 strikes reset lever 50 in the past-cocked position of hammer 40 pivoting reset lever 50 from the open position to the closed position, and reset lever 50 in turn acts on cam surface 35 to concurrently pivot disconnector 30 from the engaged position of disconnector hook 33 to the disengaged position of disconnector hook 33 and trigger body 23 from the released position of trigger nose 24 to the set position of trigger nose 24 in preparation to be received by trigger notch 49 in the cocked position of hammer 40 while at the same time lowering tail 25A of trigger body 23 away from selector 70.

In sum, arm 53 of reset lever 50 intercepts hammer 40 in the past-cocked position of hammer 40 just after hammer disconnect notch 47 of the rearwardly pivoting hammer 40 clips past disconnector hook 33 with a sharp, glancing blow as hammer 40 moves toward and beyond the cocked position in FIG. 12 to the past-cocked position in FIG. 13. The contact interaction between hammer 40 and reset lever 50 isolates hammer 40 from trigger disconnector assembly 39. This prevents hammer 40 from striking trigger disconnector assembly 39 in the past cocked position of hammer 40, including trigger body 23, disconnector 30, disconnector lever 32, and cam surface 35. The interaction of reset lever 50 between hammer 40 and trigger disconnector assembly 39 in the various aspects discussed above, assists in resetting trigger disconnector assembly 39 from its discharged position to its charged position in the past-cocked position of hammer 40. The interaction of reset lever 50 between hammer 40 and trigger disconnector assembly 39 according to the various aspects discussed herein is maintained in the over-travel of hammer 40 in the past cocked position, and this accelerates the resetting of trigger disconnector assembly 39 from the discharged position to the charged position because arm 53 of reset lever 50 is acting on cam surface 35 to pivot trigger disconnector assembly 39 from the discharged position to the charged position throughout the past-cocked over-travel of hammer 40. Downward movement of hammer 40 in the past-cocked position is eventually arrested by hammer tail 46 engaging arm 53 in the closed position of arm 53 in the closed position of reset lever 50, according to the principle of the invention, at which point hammer 40 snaps forwardly. Once trigger disconnector assembly 39 is in the charged position, disconnector hook 33 is in its disengaged position free from interfering with hammer disconnect notch 47 and trigger nose 24 is in its set position in preparation to be received by the trigger notch 49 in the cocked position of hammer 40. As hammer 40 then pivots forwardly from the past-cocked position toward the cocked position, hammer disconnect notch 47 passes by disconnector hook 33 and trigger nose 24 is received trigger notch 49 as in FIG. 5, holding hammer 40 in the cocked position resetting trigger 27 of trigger body 23 to hammer 40 preparatory to firing by another trigger 27 pull. This is the trigger-to-hammer assisted reset feature of the assisted-reset semi-automatic mode of operation of trigger mechanism 20. The accelerated resetting of trigger disconnector assembly 39 from the discharged position to the charged position resulting from the interaction of reset lever 50 between trigger disconnector assembly 39 and hammer 40 in the past-cocked position quickens the rate of semi-automatic fire in the assisted-reset semi-automatic mode of operation of trigger mechanism 20 and allows for faster trigger pulls between each fired round, which is particularly advantageous, particularly when a faster rate of semi-automatic fire is required, such as in combat situations and competitive shooting events.

FIG. 19 is a side elevation view of trigger body 23, selector 70, and hammer 40 oriented as in FIG. 5 illustrating selector 70 in the assisted-reset semi-automatic mode of operation, and illustrating trigger body 23 in the set position holding hammer 40 in the cocked position. Disconnector 30 is not shown in FIG. 17, but is shown and referenced in FIGS. 1-13. Selector 70 has stop body 78. As previously described, stop body 78 is located near, above, and opposite to, notch 25 of tail 25A of trigger body 23, stop body 78 includes two stops, including stop 78A and stop 78B, stops 78A and 78B are surfaces of stop body 78, and here stops 78A and 78B are perpendicular relative to each other.

In the first position of selector 70 corresponding to the semi-automatic mode of operation of selector 70 as in FIG. 17, stop 78A is registered with, meaning aligned with, notch 25 of tail 25A. In a second position of selector 70 corresponding to the assisted-reset semi-automatic mode of operation of selector 70 as in FIG. 17, stop 78B is registered with, meaning aligned with, tail 25A, specifically notch 25 of tail 25A. With trigger nose 24 received in trigger notch 49 holding hammer 40 in the cocked position in preparation for firing, a distance D2 is defined between semi-automatic stop 78B and tail 25A, specifically notch 25 of tail 25A. Again, in the assisted-reset semi-automatic mode of operation of trigger mechanism 20 in preparation for firing trigger body 23 and trigger nose 24 are each in a set position, and in this set position of trigger body 23 trigger nose 24 at head 24A is received in trigger notch 49 in preparation for pulling trigger 27 to release hammer 40. Upon pulling trigger 27 so as to move trigger body 23 and trigger 27 the trigger pulling travel distance in the assisted-reset semi-automatic mode of operation from the set position holding hammer 40 to the pulled/fired position releasing hammer 40, trigger nose 24 is lowered out of trigger notch 49 from the set position to a released position, releasing hammer 40, while at the same time raising tail 25A of trigger body 23 toward stop 78B of stop body 78 of selector 70 closing distance D2 between notch 25 of tail 25A of trigger body 23 so as to bring notch 25 of tail 25A of trigger body 23 into direct contact against stop 78B of stop body 78. Upward movement of tail 25A of trigger body 23 is thus arrested by notch 25 of tail 25A contacting stop 78B of stop body 78 which, in turn, and arrests movement of trigger body 23, or in other words limits or otherwise arrests the pivotal movement of trigger 27 and trigger body 23 past the pulled/fired position in the assisted-reset semi-automatic mode of operation. Trigger body 23 and trigger 27 in turn move the trigger reset travel distance in the assisted-reset semi-automatic mode of operation from the pulled position to the set position. In the assisted-reset semi-automatic mode of operation of trigger mechanism 20, the trigger pulling and trigger reset travel distances of trigger body 23 and trigger 27 are equal.

Distance D1 denoted in FIGS. 15 and 17 is greater than distance D2 denoted in FIGS. 16 and 19. Because distance D2 is less than distance D1, the trigger pull travel distance of trigger body 23 and trigger 27 from the set position thereof to the pulled/fired position thereof in the second position of selector 70 corresponding to the assisted reset semi-automatic mode of operation of trigger mechanism 20 is less than the trigger pull travel distance of trigger body 23 and trigger 27 from the set position thereof to the pulled/fired position in the first position of selector 70 corresponding to the semi-automatic mode of operation of trigger mechanism 20, and the trigger reset travel distance of trigger body 23 and trigger 27 from the pulled/fired position thereof to the set position thereof in the second position of selector 70 corresponding to the assisted reset semi-automatic mode of operation of trigger mechanism 20 is less than the trigger rest travel distance of trigger body 23 and trigger 27 from the pulled/fired position thereof to the set position in first position of selector 70 corresponding to the semi-automatic mode of operation of trigger mechanism 20. The lessened trigger pull and trigger reset travel distances of trigger body 23 and trigger 27 in second position of selector 70 corresponding to the assisted-reset mode of operation of trigger mechanism 20 compared to the first position of selector 70 corresponding to the semi-automatic mode of operation allows for a more rapid repeated pulling and resetting of trigger body 23 and trigger 27 and thus a more rapid rate of repeated semi-automatic fire in the second position of selector 70 than in the first position of selector 70. Also, the lessened trigger reset travel distance in the second position of selector 70 corresponding to the assisted-reset semi-automatic mode of operation of trigger mechanism 20 compared to the first position of selector 70 corresponding to the semi-automatic mode of operation produces less trigger snap of the trigger 27 from the pulled/fired position to the reset position and thus less discomfort on the shooter's trigger finger from prolonged firing activities.

Figure 18:
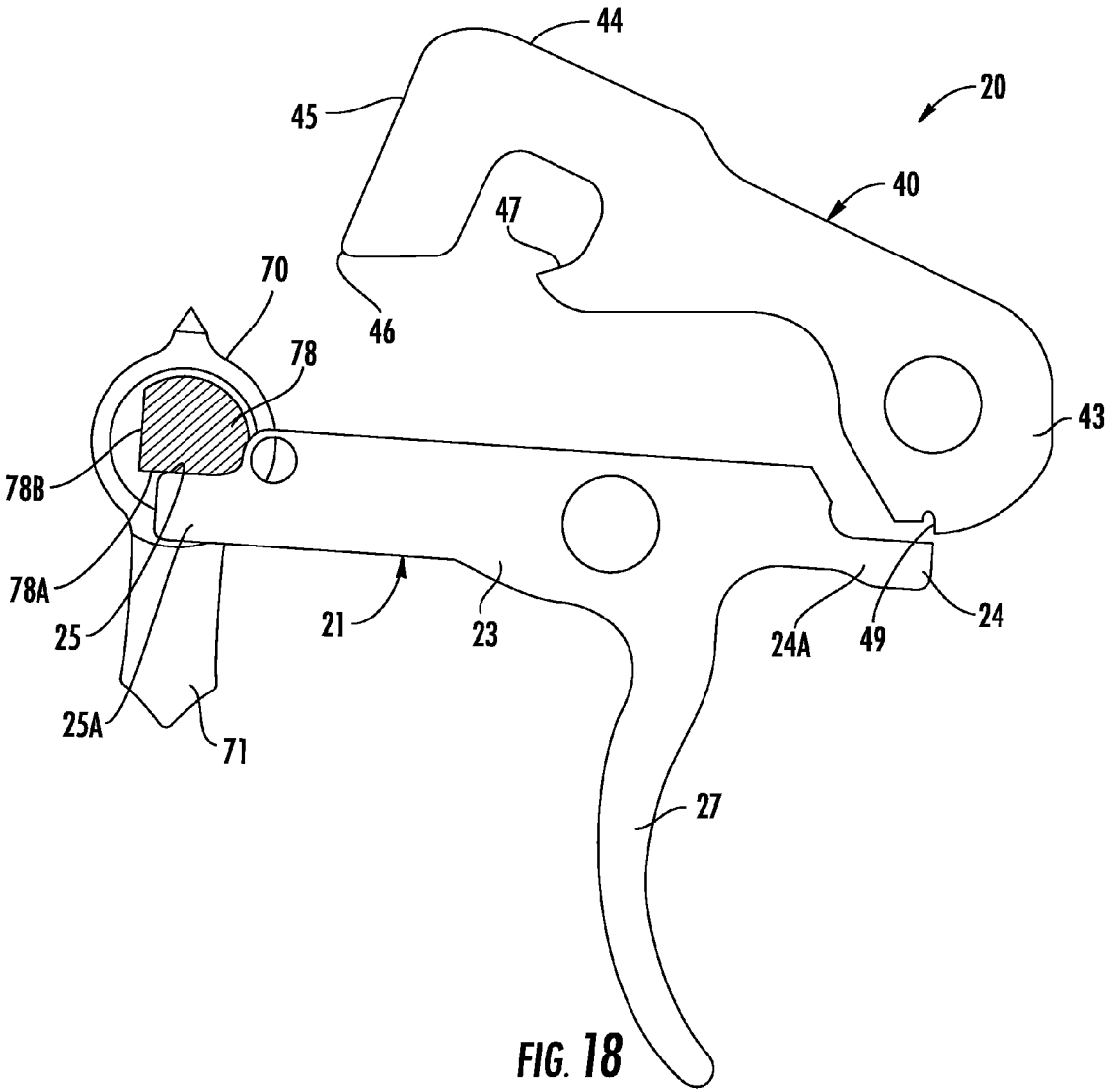
FIG. 18 is a view of the embodiment of FIG. 17 illustrating the trigger body as it would appear in a pulled or fired position and a tail of the trigger body shown as it would appear contacting a first stop of the selector.

According then to the principle of the invention with reference to FIGS. 17-19, trigger mechanism 20 includes trigger assembly 21 with hammer 40 having trigger notch 49, trigger body 23 with trigger nose 24, trigger tail 25A, and trigger 27, trigger nose 24 for receiving trigger notch 49 in the cocked position of hammer 40 and the set position of trigger body 23 and for releasing trigger nose 24 when trigger body 23 is moved a travel distance from the set position to a fired position, disconnector 30 (shown in FIGS. 1-14), coupled between hammer 40 and trigger body 23, and selector 70 movable between a first position as in FIGS. 17 and 18, which corresponds to the semi-automatic mode of fire or operation, and a second position as in FIGS. 19 and 20, which corresponds to the assisted-reset semi-automatic mode of fire or operation, for adjusting the travel distance of trigger body 23 from the set position to the fired position and from the fired position back to the set position. Selector 70 has stop 78A aligned with notch 25 of tail 25A of trigger body 23 in the first position of selector 70 as in FIGS. 17 and 18, and stop 78B aligned with notch 25 of tail 25A of trigger body 23 in the second position of selector 70 as in FIGS. 19 and 20. Stop 78A is separated from tail 25A, specifically notch 25 of tail 25A, of trigger body 23 distance D1 in the set position of trigger body 23 in the first position of the selector 70 as in FIGS. 17 and 18. Stop 78B is separated from tail 25A, specifically notch 25 of tail 25A, of trigger body 23 distance D2 in the set position of trigger body 23 in the second position of selector 70 as in FIGS. 19 and 20. In the first position of selector 70 and the fired position of trigger body 23 as in FIG. 18, distance D1 of FIG. 17 between stop 78A and tail 25A, specifically notch 25 of tail 25A, of trigger body 23 is closed and tail 25A, specifically notch 25 of tail 25A, contacts stop 78A, and movement of trigger body 23 in a direction from the set position to the fired position is arrested by tail 25A, specifically notch 25 of tail 25A, contacting stop 78A. In the second position of selector 70 and the fired position of trigger body 23 as in FIG. 20, distance D2 between stop 78B and tail 25A, specifically notch 25 of tail 25A, of trigger body 23 is closed and tail 25A, specifically notch 25 of tail 25A, contacts stop 78B, and movement of trigger body 23 is arrested by tail 25A, specifically notch 25 of tail 25A, contacting stop 78B. Distance D2 is less than distance D1, wherein the travel distance of trigger body 23 in the second position of selector 70 as in FIGS. 19 and 20 is less than the travel distance of trigger body 23 in the first position of selector 70 as in FIGS. 17 and 18.

The present invention is described above with reference to preferred embodiments. However, those skilled in the art will recognize that changes and modifications may be made in the described embodiments without departing from the nature and scope of the present invention. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A trigger mechanism, comprising:

a trigger assembly, a reset lever, and a hammer, the trigger assembly moves between charged and discharged orientations, and the hammer moves between a firing position, a cocked position, and a past-cocked position;

the trigger assembly is in a hammer-engaging position, in the charged orientation of the trigger assembly;

the trigger assembly is in a hammer-releasing position, in the discharged orientation of the trigger assembly; and the reset lever acts on the trigger assembly to move the trigger assembly from the discharged orientation to the charged orientation to position the trigger assembly in the hammer-engaging position for engaging the hammer in the cocked position of the hammer, in response to the hammer striking the reset lever in the past-cocked position of the hammer.

2. A trigger mechanism, comprising:

a trigger assembly, a reset lever, and a hammer, the trigger assembly includes a disconnector hook and moves between charged and discharged orientations, and the hammer includes a hammer disconnect notch and moves between a firing position, a cocked position, and a past-cocked position;

the disconnector hook is in a disengaged position relative to the hammer disconnect notch, in the charged orientation of the trigger assembly;

the disconnector hook is in an engaged position relative to the hammer disconnect notch, in the discharged orientation of the trigger assembly; and the reset lever acts on the trigger assembly to move the trigger assembly from the discharged orientation to the charged orientation to position the disconnector in the disengaged position of the disconnector hook relative to the hammer disconnect notch, in response to the hammer striking the reset lever in the past-cocked position of the hammer.

3. A trigger mechanism, comprising:

a hammer, a trigger body having a trigger tail and a trigger nose for holding the hammer in a cocked position of the hammer in a set position of the trigger body and for releasing the hammer when the trigger body is moved a travel distance from the set position to a fired position of the trigger body, and a selector movable between a first position and a second position for adjusting the travel distance of the trigger body;

the selector has a first stop aligned with the tail of the trigger body in the first position, and a second stop aligned with the tail of the trigger body in the second position;

the first stop is separated from tail of the trigger body a first distance in the set position of the trigger body in the first position of the selector, and the second stop is separated from tail of the trigger body a second distance in the set position of the trigger body in the second position of the selector;

in the first position of the selector and the fired position of the trigger body the first distance between the first stop and the tail of the trigger body is closed and the tail contacts the first stop, and movement of the trigger body is arrested by the tail contacting the first stop;

in the second position of the selector and the fired position of the trigger body the second distance between the second stop and the tail of the trigger body is closed and the tail contacts the second stop, and movement of the trigger body is arrested by the tail contacting the second stop; and the second distance is less than the first distance, wherein the travel distance of the trigger body in the second position of the selector is less than the travel distance of the trigger body in the first position of the selector.

* * * * *